US007143987B2

(12) United States Patent
Salani

(10) Patent No.: US 7,143,987 B2
(45) Date of Patent: Dec. 5, 2006

(54) CAN SUPPORT DEVICE FOR SUPPORTING PAINT CANS ON A SUPPORT STRUCTURE AND METHOD OF FORMING THE SAME

(76) Inventor: Ted Salani, 7721 Dalewood Pkwy., Woodridge, IL (US) 60517

( * ) Notice: Subject to any disclaimer, the term of this patent is extended or adjusted under 35 U.S.C. 154(b) by 159 days.

(21) Appl. No.: 10/887,545

(22) Filed: Jul. 8, 2004

(65) Prior Publication Data

US 2005/0056754 A1 Mar. 17, 2005

Related U.S. Application Data

(63) Continuation-in-part of application No. 10/209,212, filed on Jul. 30, 2002, now Pat. No. 6,783,103.

(51) Int. Cl.
*E06C 7/14* (2006.01)

(52) U.S. Cl. ..... 248/211; 248/210; 248/311.2; 182/129

(58) Field of Classification Search ..... 248/211, 248/210, 238, 311.2, 215; 189/129
See application file for complete search history.

(56) References Cited

U.S. PATENT DOCUMENTS

| | | | | |
|---|---|---|---|---|
| 1,283,160 | A * | 10/1918 | Gross | 248/210 |
| 2,524,875 | A | 10/1950 | Beaver | |
| 2,911,016 | A | 11/1959 | Kenney | |
| 2,920,853 | A | 1/1960 | Bufogle | |
| 3,108,776 | A | 10/1963 | Cook | |
| 3,160,383 | A | 12/1964 | Lamm | |
| 3,278,148 | A | 10/1966 | Denaro | |
| 3,312,441 | A | 4/1967 | Molenda | |
| 3,414,311 | A | 12/1968 | Trimboli | |
| 3,448,956 | A | 6/1969 | Kuhaneck, Jr. | |
| 3,462,109 | A | 8/1969 | Forbes | |
| 3,707,242 | A | 12/1972 | Golden et al. | |
| 3,738,601 | A | 6/1973 | Gehringer | |
| 3,863,883 | A | 2/1975 | Cousins | |
| 3,895,772 | A | 7/1975 | Ellingson | |
| 3,940,824 | A | 3/1976 | Gioia et al. | |
| 3,980,264 | A | 9/1976 | Tomasik | |
| 4,053,131 | A | 10/1977 | Francis | |
| 4,071,214 | A | 1/1978 | Reidy | |
| 4,099,693 | A * | 7/1978 | Blann | 248/210 |
| 4,205,411 | A | 6/1980 | Cupp et al. | |
| 4,433,822 | A | 2/1984 | Caggiano | |
| D291,168 | S | 8/1987 | Cranford | |
| 4,702,446 | A | 10/1987 | Brown | |

(Continued)

FOREIGN PATENT DOCUMENTS

| | | |
|---|---|---|
| DE | 87 12 533 U1 A1 | 2/1988 |

*Primary Examiner*—Amy J. Sterling
(74) *Attorney, Agent, or Firm*—Marshall, Gerstein & Borun LLP

(57) ABSTRACT

A device for supporting a container having a wire handle and a sidewall on a support structure is disclosed. The device includes a pair of spaced apart side members, with each of the side members having an upper portion adapted to engage the support structure and a notch sized to receive the wire handle. A central portion of the device is disposed between the side members, with the central portion defining a receiving area sized and shaped to receive the container such that the receiving area engages only the sidewall of the container. The device further includes a pair of spaced apart accessory supports that extend generally upward from the central portion.

10 Claims, 20 Drawing Sheets

U.S. PATENT DOCUMENTS

| | | | |
|---|---|---|---|
| 4,787,586 | A | 11/1988 | Crain |
| 4,890,807 | A | 1/1990 | Desjardins |
| 4,899,970 | A | 2/1990 | Berzina |
| 5,016,773 | A | 5/1991 | Lockwood |
| 5,031,723 | A | 7/1991 | Hooten |
| 5,062,607 | A | 11/1991 | Kisner |
| 5,079,795 | A | 1/1992 | Schmid |
| 5,482,339 | A | 1/1996 | Chishko, Jr. |
| 5,493,751 | A | 2/1996 | Misiukowiec et al. |
| 5,584,520 | A | 12/1996 | Niemeier |
| 5,716,034 | A | 2/1998 | Unkefer |
| 5,778,489 | A | 7/1998 | Marshal, II |
| 5,842,253 | A | 12/1998 | Ahl et al. |
| 6,027,152 | A | 2/2000 | Sawdey |
| 6,105,911 | A | 8/2000 | Olexson |
| 6,474,607 | B1 | 11/2002 | Wilson |

* cited by examiner

CAN SUPPORT DEVICE FOR SUPPORTING PAINT CANS ON A SUPPORT STRUCTURE AND METHOD OF FORMING THE SAME

RELATED APPLICATIONS

This application is a continuation-in-part of U.S. patent application Ser. No. 10/209,212, filed Jul. 30, 2002 now U.S. Pat. No. 6,783,103.

FIELD OF THE DISCLOSURE

The present invention relates generally to a device for securing a can, such as a paint can, to a support structure such as ladder, and method of forming such a device.

BACKGROUND OF THE DISCLOSURE

Painters working on a ladder may find it desirable to secure a can of paint to the ladder. Once the can of paint is secured to the ladder, the painter can focus on the job at hand with two free hands without having to constantly hold or balance the paint can. Securement of the paint can also reduces or eliminates inadvertent spills.

The prior art includes a number of examples of devices for securing paint cans to ladders. Nevertheless, there exists a continuing need for improvements in such devices.

DETAILED DESCRIPTION

The following description of the disclosed exemplary embodiments is not intended to limit the scope of the invention to the precise form or forms detailed herein. Instead, the following description is intended to be illustrative of the principles of the invention so that others may follow its teachings.

Figure 1:
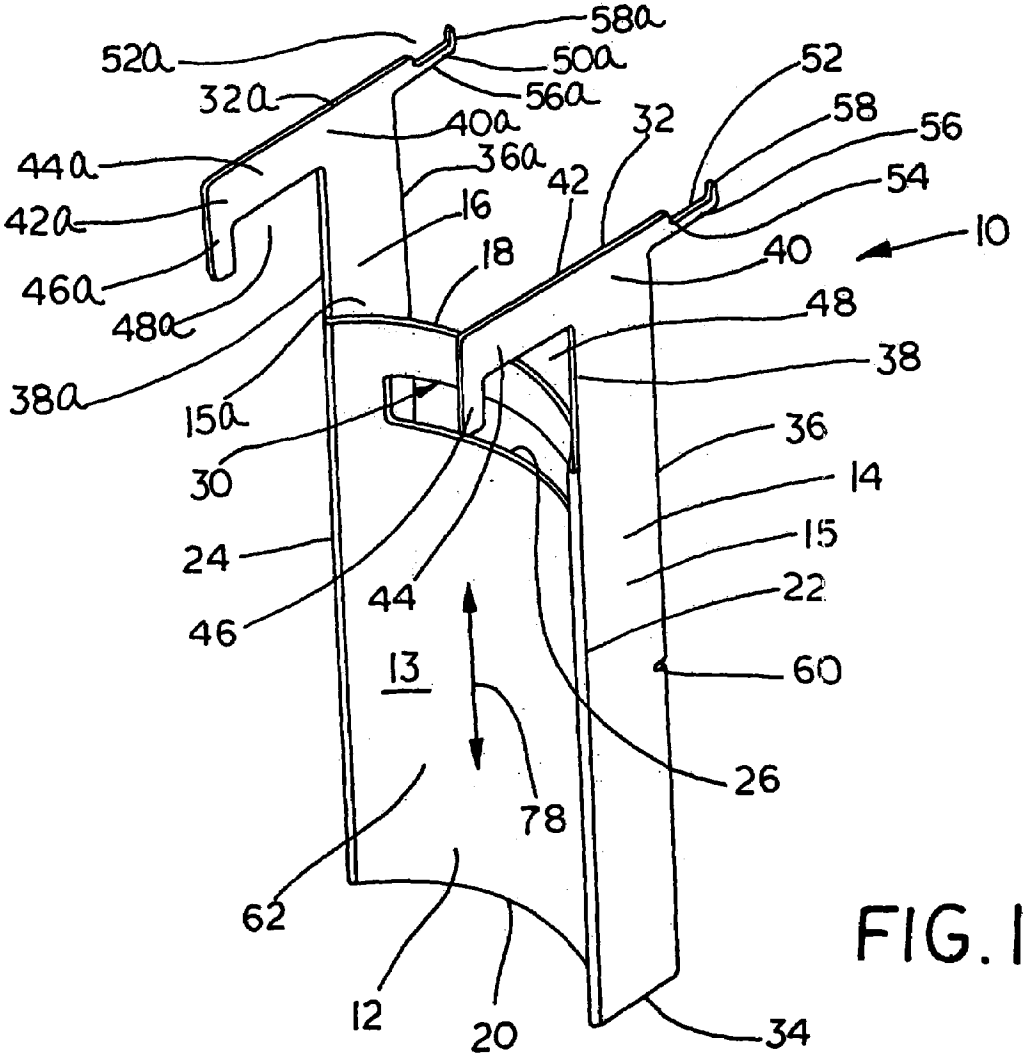
FIG. 1 is a perspective view of a can support device assembled in accordance with the teachings of a first disclosed example of the present invention.
Figure 2:
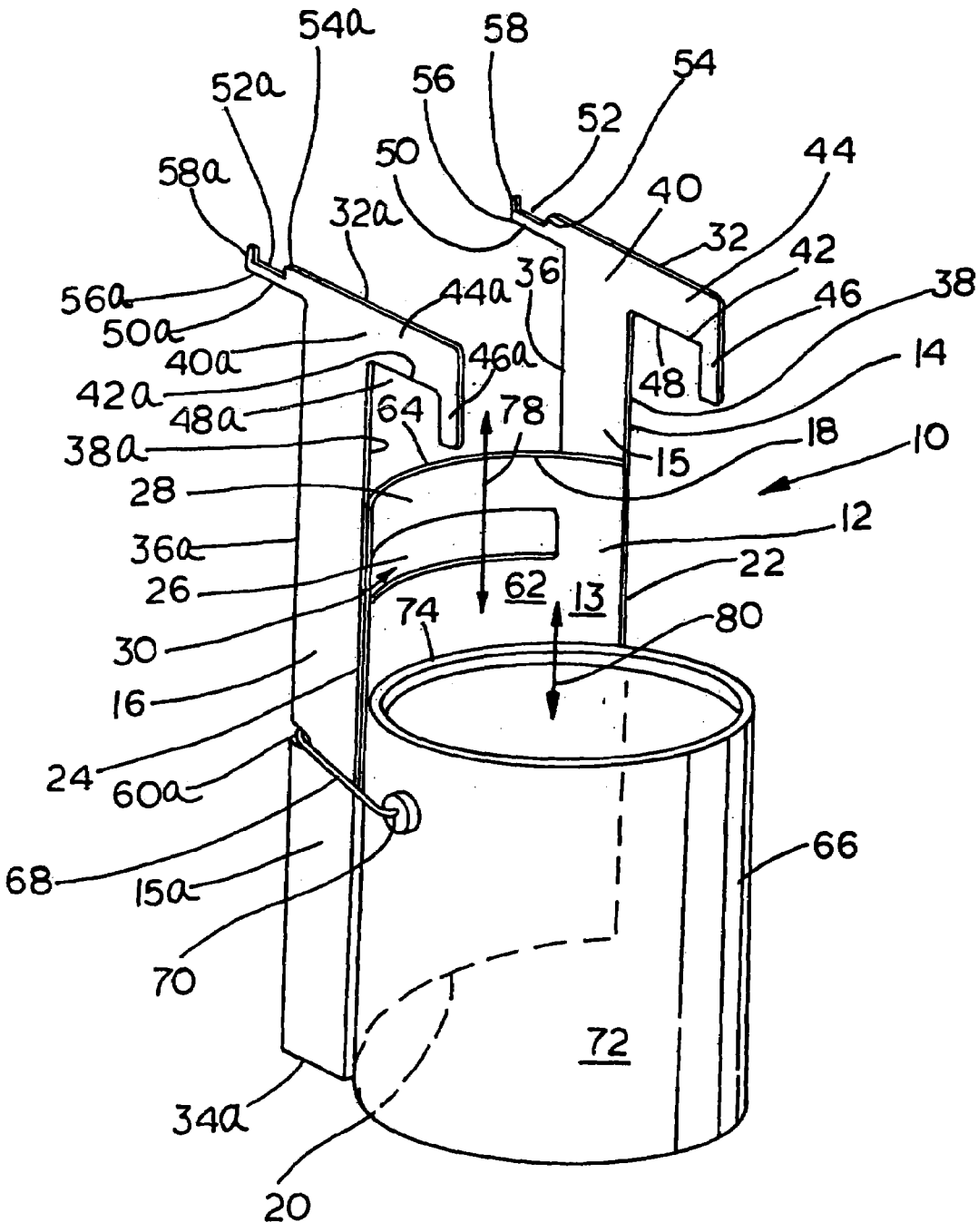
FIG. 2 is a front perspective view of the device of FIG. 1 and illustrating the device supporting a can.
Figure 3:
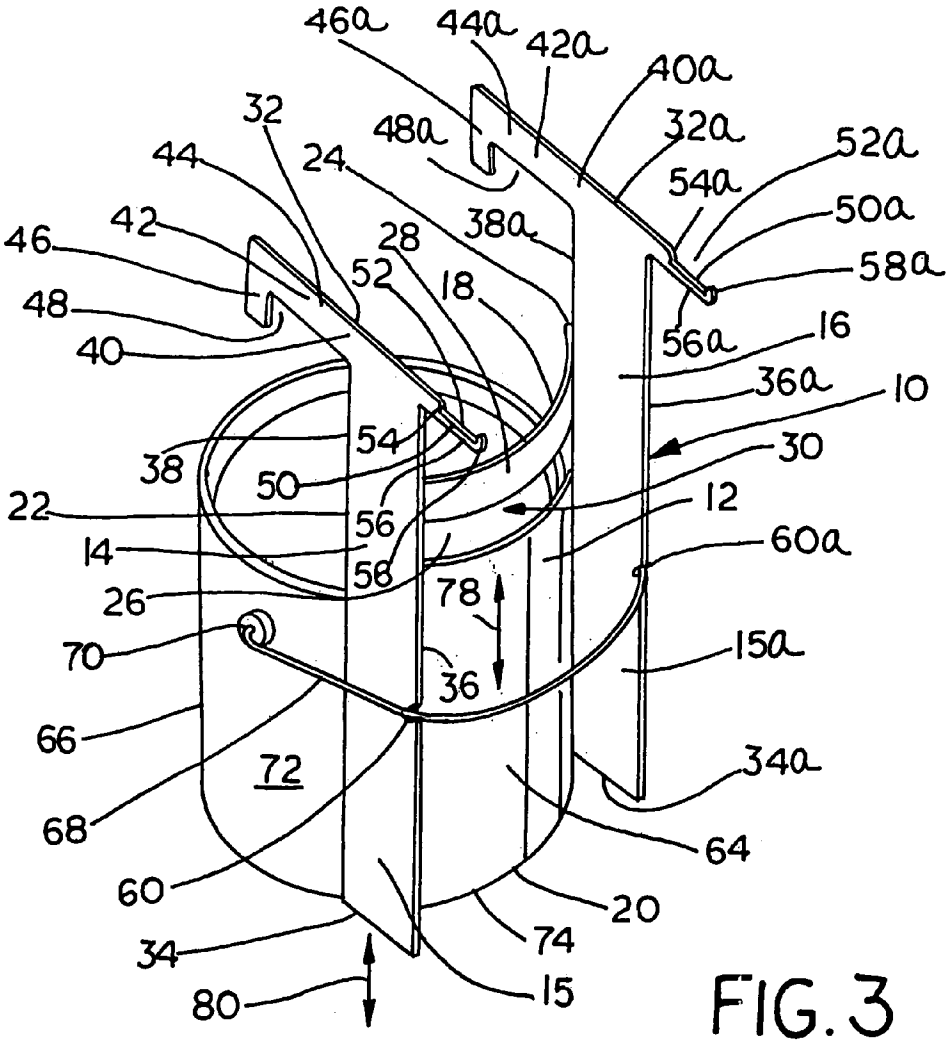
FIG. 3 is a rear perspective view of the device shown in FIG. 2.

Referring now to FIGS. 1–3 of the drawings, a can support device assembled in accordance with the teachings of the present invention is generally referred to by the reference numeral 10. The can support device 10 includes a central section 12 and a pair of side members 14, 16. The central section 12 includes a top edge 18, a bottom edge 20, and is generally bounded by a pair of fold line 22, 24. It will be noted that the side member 14 generally meets the central section 12 at the fold line 22, while the side members 16 generally meets the central section 12 along the fold line 24. The central section 12 also includes a cutout 26 which extends generally parallel to the top edge 18, and which is separated from the top edge 18 by a cross member 28, such that the cutout 26 and the cross member 28 cooperate to form a handle 30.

The side member 14 includes an upper edge 32, a lower edge 34 and a side edge 36, with the side edge 36 preferably extending generally parallel to the fold line 22. The side member 14 also includes a side edge 38 which extends generally parallel to the side edge 36, with the edge 38 generally extending upwardly from the fold line 22. Thus, the side edge 38 is generally parallel to and across from an upper portion of the side edge 36.

The side member 14 includes an upper portion 40. The upper portion 40 includes a first hook 42 defined by a pair of legs 44, 46. The legs 44, 46 and the edge 38 cooperate to define a receiving area 48. It will be noted that the receiving area 48 of the hook 42 faces in a generally downward direction when the can support device 10 is oriented as shown. The upper portion 40 also includes a second hook 50 which generally extends from the side edge 36. The second hook 50 includes a receiving area 52 which is defined at least in part by an edge 54 and a pair of legs 56, 58. It will be noted that the receiving area 52 of the second hook 50 is oriented in a generally upward direction. The side edge 36 of the side member 14 includes an angled notch 60 (FIGS. 1 and 3).

In the disclosed example, the side member 14 forms a generally planar panel 15 while the side member 16 forms a generally planar panel 15*a*. The panel 15 is generally contiguous and runs between the pair of hooks 42, 50 in the upper portion 40 and the lower edge 34 at the bottom of the side member 14. The panel 15 is further bounded by the side edge 36, the side edge 38 and the fold line 22.

Similarly, the side member 16 includes an upper edge 32*a*, a lower edge 34*a*, and a side edge 36*a*, with the side edge 36*a* preferably extending generally parallel to the fold line 24. The side member 16 also includes a side edge 38*a* which extends generally parallel to the side edge 36*a*, with the side edge 38*a* generally extending upwardly from the fold line 24. Thus, the side edge 38*a* is generally parallel to and across from an upper portion of the side edge 36*a*.

The side member 16 includes an upper portion 40*a*. The upper portion 40*a* includes a first hook 42*a* defined by a pair of legs 44*a*, 46*a*. The legs 44*a*, 46*a* and the side edge 38*a* cooperate to define a receiving area 48*a*. It will be noted that the receiving area 48*a* of the hook 42*a* faces in a generally downward direction when the can support device 10 is oriented as shown, and the receiving area 48*a* is oriented in the same general direction as the receiving area 48 of the first hook 42 on the side member 14.

Figure 3A:
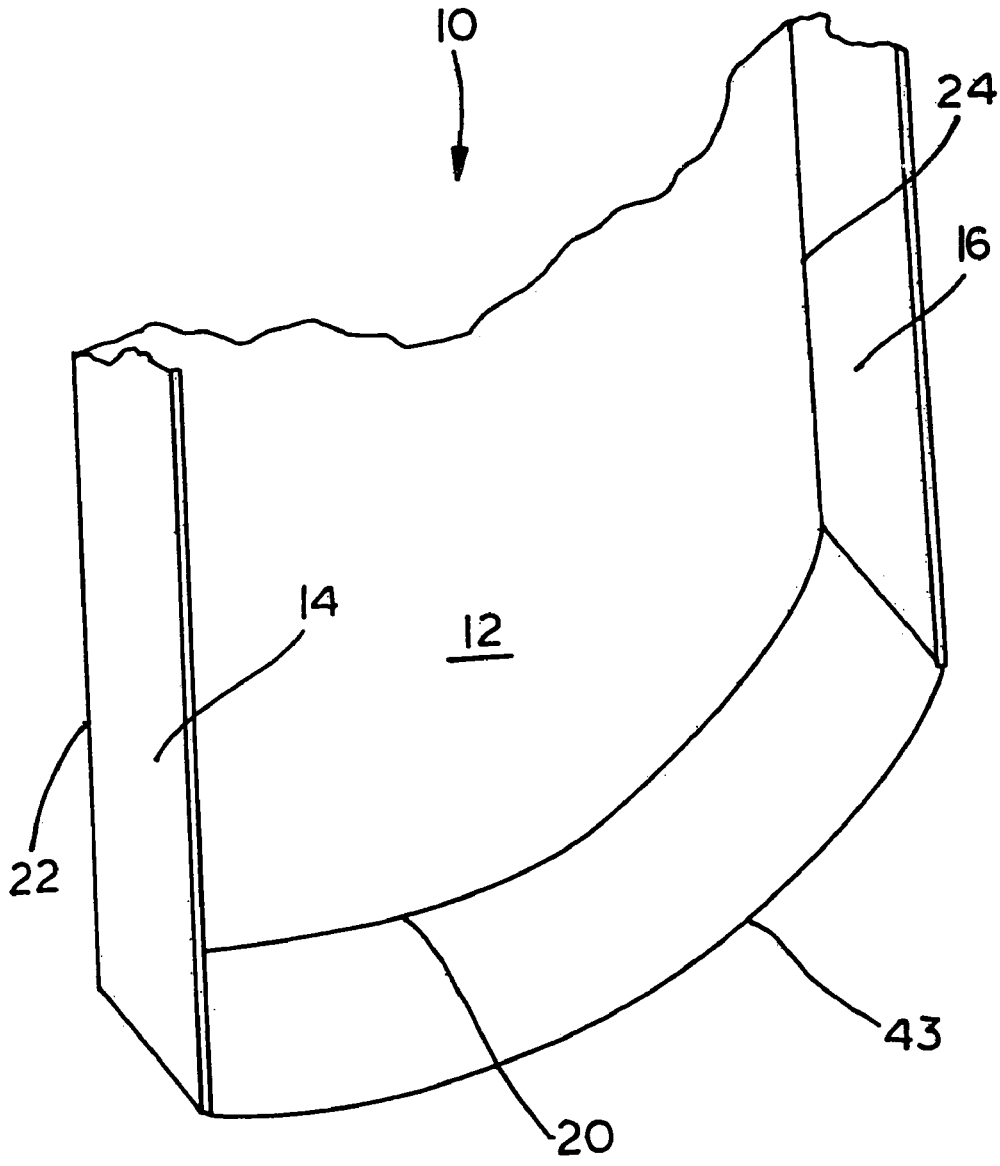
FIG. 3A is a fragmentary view in perspective of a rear side of the can support device of FIG. 1 and illustrating an optional rib extending across the width of the central section.
Figure 3B:
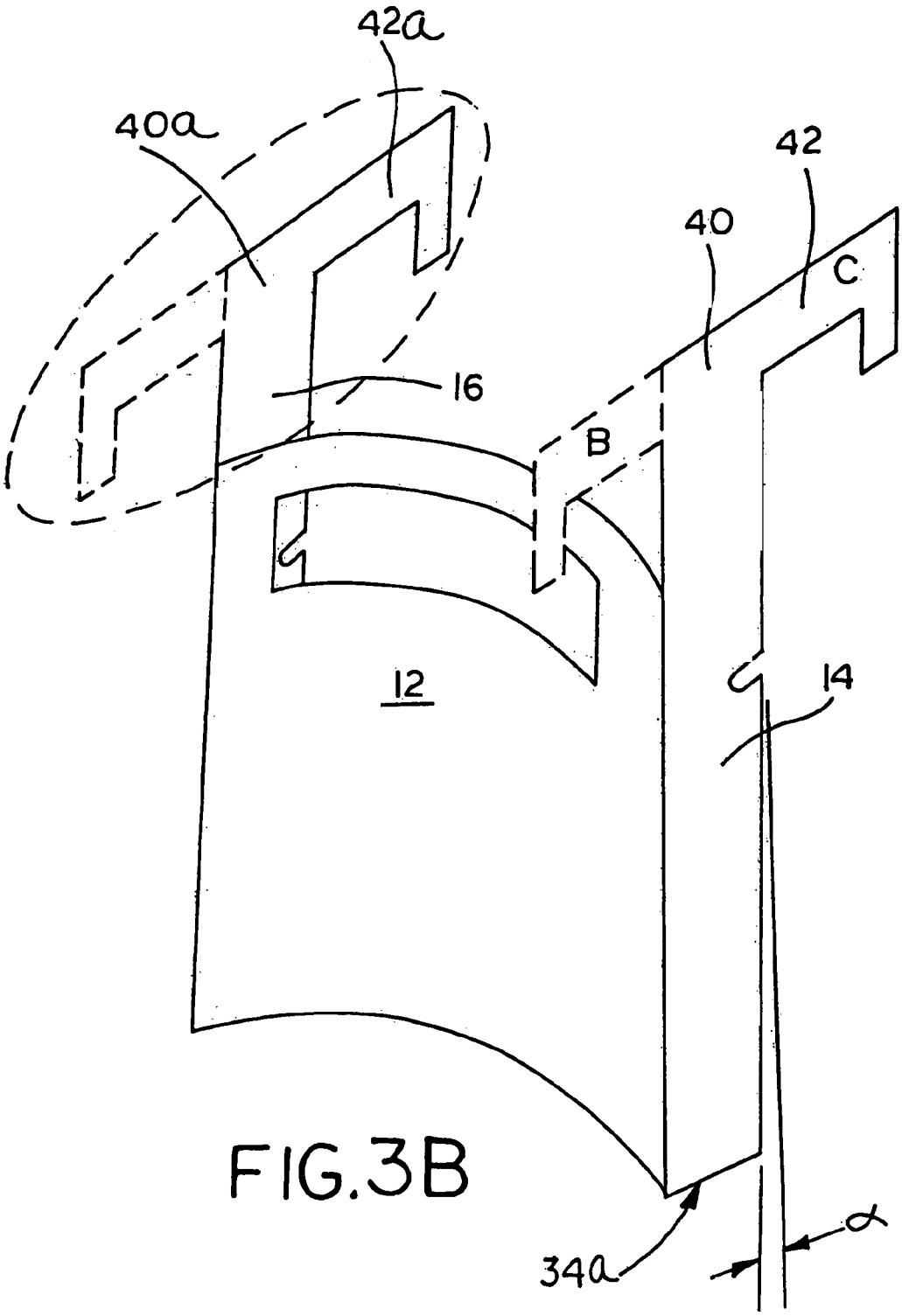
FIG. 3B is a front perspective view of a can support device similar to that shown in FIG. 1 and illustrating an optional hook arrangement and an optional tapered side member.

Referring to FIG. 3B, the hooks 42, 42*a* on the upper portion 40, 40*a* of the side members 14, 16 may be arranged in alternative configurations (configuration C shown in solid lines in FIG. 3B or configuration B shown in dotted lines in FIG. 3B). For example, the hooks 42, 42*a* may be built in the configuration C wherein the hooks, 42, 42*a* face rearward from the central section 12. Alternatively, the hooks 42, 42*a* may be built in the configuration B wherein the hooks 42, 42*a* face forward and in the same direction as the curvature of the central section 12. Alternatively, the can support device may be built with both configurations B and C incorporated. This can be accomplished by fixing (molding in) a pair of downward facing hooks in opposite directions of each other in the upper portion 40, 40*a* of the side members 14, 16. As shown in FIG. 3B, when the configurations B and C are both incorporated, the side members 14, 16 would each include a pair of downwardly facing hooks, one pair of hooks 42 and 42*a*, respectively, extending rearwardly, and the other pair of hooks (as indicated by the dotted lines of configuration B) extending forwardly. Alternatively, one hook on each side member may face upwardly, with the other hook on each side member facing downwardly.

As shown in FIGS. 1–3, the side member 14 may form a generally planar panel 15, such that the pair of hooks 42, 50 in the upper portion 40 and the lower edge 34 at the bottom of the side member 14 are all disposed in a common plane. Similarly, the side member 16 may form a generally planar panel 15*a*, such that the pair of hooks 42*a*, 50*a* in the upper portion 40*a* and the lower edge 34*a* at the bottom of the side member 16 are all disposed in a common plane. Each of the panels 15 and 15*a* are further bounded by the side edges 36 and 36*a*, the side edges 38 and 38*a*, and the fold lines 22 and 24, respectively.

Figure 10:
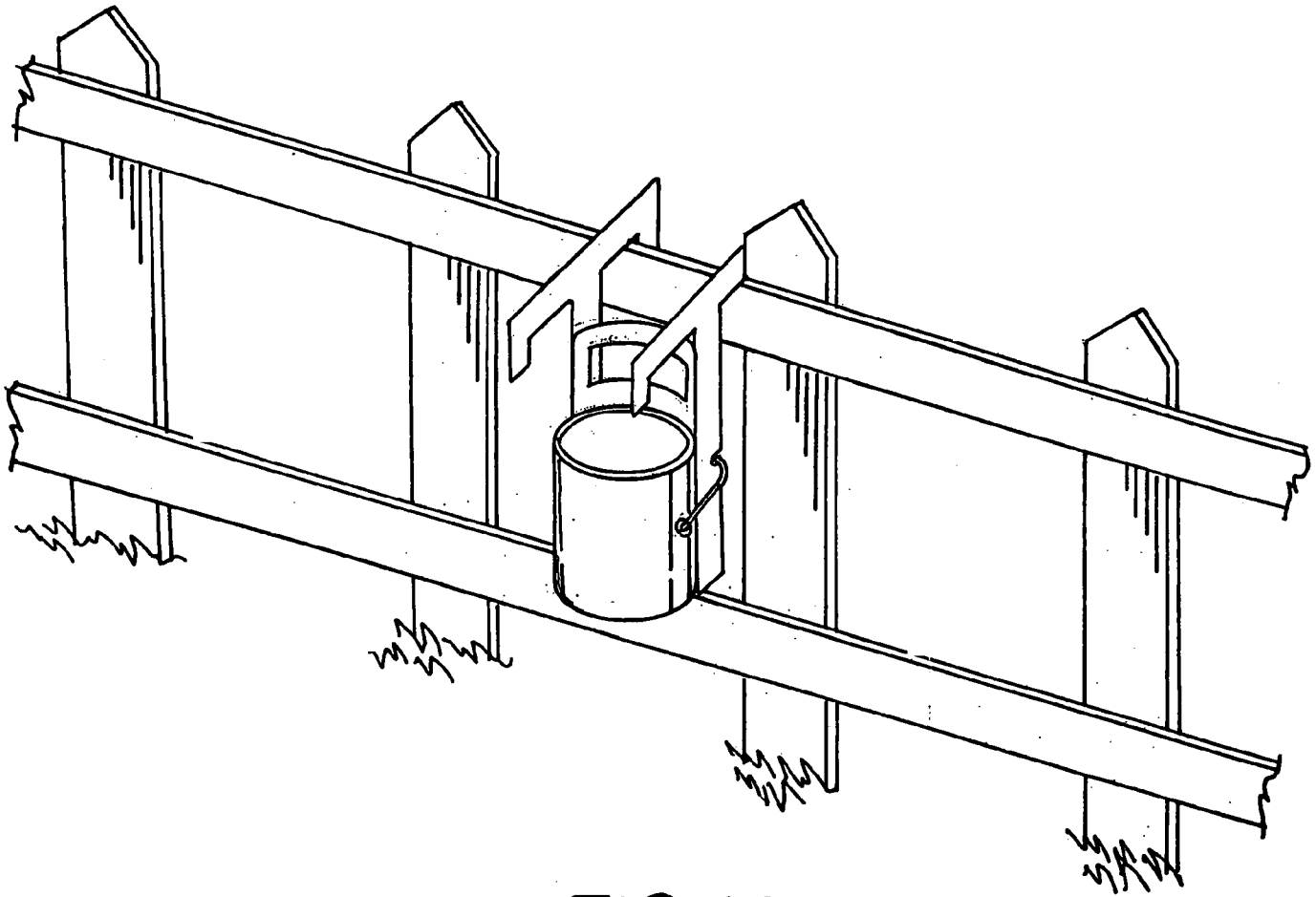
FIG. 10 is a perspective view of a can support device similar to that shown in FIG. 3B and illustrated attached to a fence.
Figure 11:
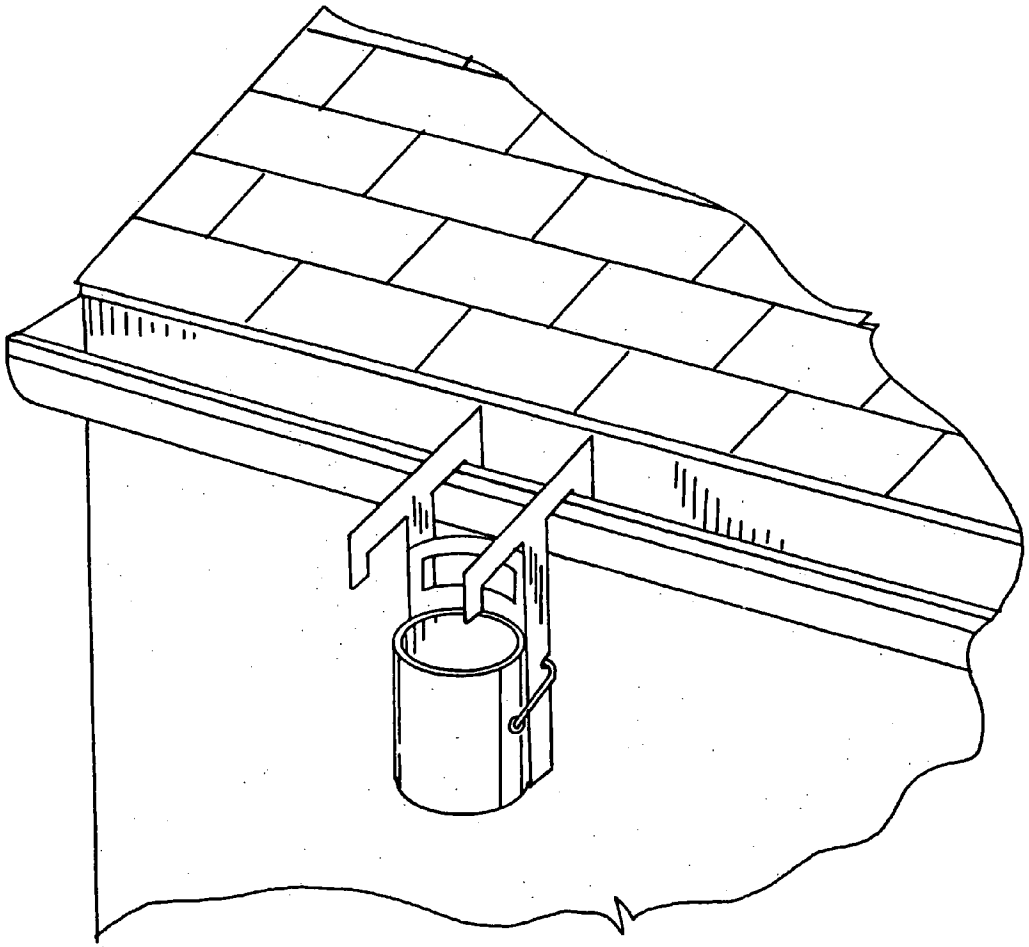
FIG. 11 is a perspective view of a can support device similar to that shown in FIG. 3B and illustrated attached to a gutter.

When constructed with either the forward and/or the rearward facing hooks 42, 42*a* of configurations B and C, the can support device 10 may be suspended from various structures. Configuration C, for example, would accommodate suspending the can support device 10 from a ladder 76 illustrated in FIGS. 4–6. Configuration B, for example, would accommodate suspending the can support device 10 from various home structures such as fences (FIG. 10) or gutters (FIG. 11). These examples are illustrative only and are not meant to limit the scope of the invention to the applications shown.

Figure 3C:
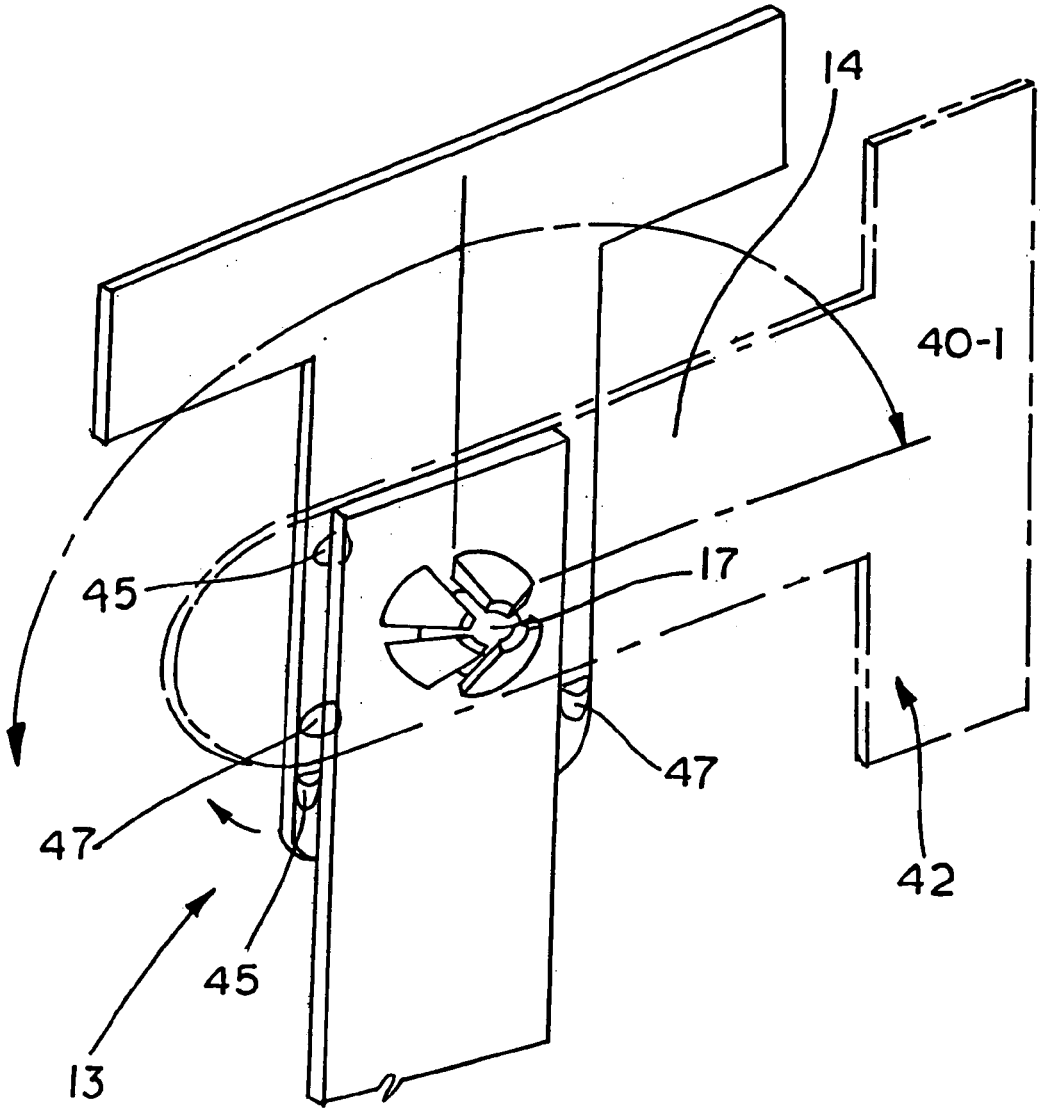
FIG. 3C is an enlarged fragmentary view in perspective of an optional adjustable hook structure.

Alternatively, the can support device 10 may include a floating leg mechanism 13 that allows one or more of the hooks 42, 42*a* to rotate up to 180° between an upright position (shown in solid lines in FIG. 3C) and a shifted position (one of which is shown in dotted lines in FIG. 3C, the other shifted position being 180 degrees from dotted lines of FIG. 3C). In the example of FIG. 3C, the hook 42 includes an upper portion 40-1 which is joined to the side member 14 by a hinge or pivot 17. It will be understood that the side member 16 may include an identical structure. However, in the interest of brevity, only the alternative structure for the hook 40 will be discussed.

The upper portion 40-1 includes two locking tabs 45 and 47. The locking tabs 45, 47 may be molded or otherwise formed so as to span the width of the side member 14 when the upper portion 40-1 is in the un-shifted position (solid lines) of FIG. 3C, and so that the locking tabs 45, 47 engage one of the side edges of the side member 14 when the upper portion 40-1 is in either one of the shifted or folded positions. As shown in FIG. 3*c*, a pivot pin 17 or other suitable structure is provided to permit the upper portion 40-1 to pivot 17 relative to the side member 14.

Thus, in the example of FIG. 3C, the hook 42 formed when the upper portion 40-1 is shifted to the folded positions may face forward or rearward, thus enabling a user to suspend the can support device 10 from various structures as discussed above.

The upper portion 40*a* also includes a second hook 50*a* which generally extends from the side edge 36*a*. The second hook 50*a* includes a receiving area 52*a* which is defined at least in part by an edge 54*a* and a pair of legs 56*a*, 58*a*. It will be noted that the receiving area 52*a* of the second hook 50*a* is oriented in a generally upward direction. The side edge 36*a* of the side member 16 includes an angled notch 60*a* (FIGS. 2 and 3), which is preferably located at the same height as the notch 60 in the side edge 36 of the side member 14.

In the disclosed example, the side member 16 forms a generally planar panel 15*a*. The panel 15*a* is generally contiguous and runs between the pair of hooks 42, 50*a* in the upper portion 40*a* and the lower edge 34*a* at the bottom of the side member 16. The panel 15*a* is further bounded by the side edge 36*a*, the side edge 38*a* and the fold line 24.

As shown in each of FIGS. 1–6, the central section 12 of the can support device 10 is generally curved. Accordingly, the central section 12 defines a concave curved surface 62 (shown in FIGS. 1 and 2–6) which forms a general receiving area 13, and also defines a convex curved surface 64 (shown in FIG. 3) on the opposite side of the can support device 10. Alternatively, the central section 12 may be similarly shaped using a plurality of spaced and generally parallel fold lines (not shown).

Referring now to FIGS. 2 and 3, it will be noted that the curvature of the central section 12 is sized and shaped to generally match the curvature of a can 66. In a preferred application, the can 66 is a one gallon paint can of the type commonly available in the retail paint trade. It will be understood that the can support device 10 can be formed in a variety of sizes so as to receive and hold a variety of other commercially available paint can sizes (not shown). The paint can 66 includes a wire handle 68 which pivots about a pair of pivots 70 as is known in the art and also includes a sidewall 71 having a curved outer surface 72. As shown, the paint can 66 may be positioned such that the outer surface 72 of the paint can 66 is disposed against the concave curved surface 62 of the central section 12. As outlined above, because the curvature of the central section 12 generally conforms to the curvature of the outer surface 72 of the paint can 66, the paint can 66 and the central section 12 will meet along a generally curved interface 74. The wire handle 68 is received in the angled notches 60, such that the paint can 66 will be secured in place attached to the can support device 10 aided by the force of gravity. It will be noted that when the can 66 is in the receiving area 13, only the sidewall 71 of the can 66 engages the can support device 10 (except for contact between the wire handle 68 and the notches 60, 60*a*). It will be understood that the can 66 also may include top and bottom rims, which for purposes of this discussion may be referred to as part of the sidewall.

As will be appreciated from one or more of the examples disclosed herein a separate support disposed underneath the bottom of the can 66 need not be provided. It will be appreciated that, depending on the shape of the central section 12, the receiving area 13 may contact the outer surface 72 of the paint can 66 along a generally curved interface, or, at a number of discrete points spaced about a portion of the circumference of the paint can 66.

The side members 14, 16 may be tapered at an angle $\alpha$ (FIG. 3B) from the upper portion 40, 40*a* to the lower edge 34, 34*a* of the side members 40, 40*a*. This angled configuration may, in the disclosed example, ease the placement of the central section 12 between the paint can 66 and the wire handle 68.

As shown in FIG. 3A, the can support device 10 may include an optional base or rib 43 that extends between the side members 14, 16, essentially extending between the pair of fold lines 22, 24 and being joined to the bottom edge 20 of the central section 12. In the disclosed example of FIG. 3A, the rib 43 may provide additional strength or additional stability to the can support device 10 in the event the can support device 10 is placed on a flat support surface.

Figure 4:
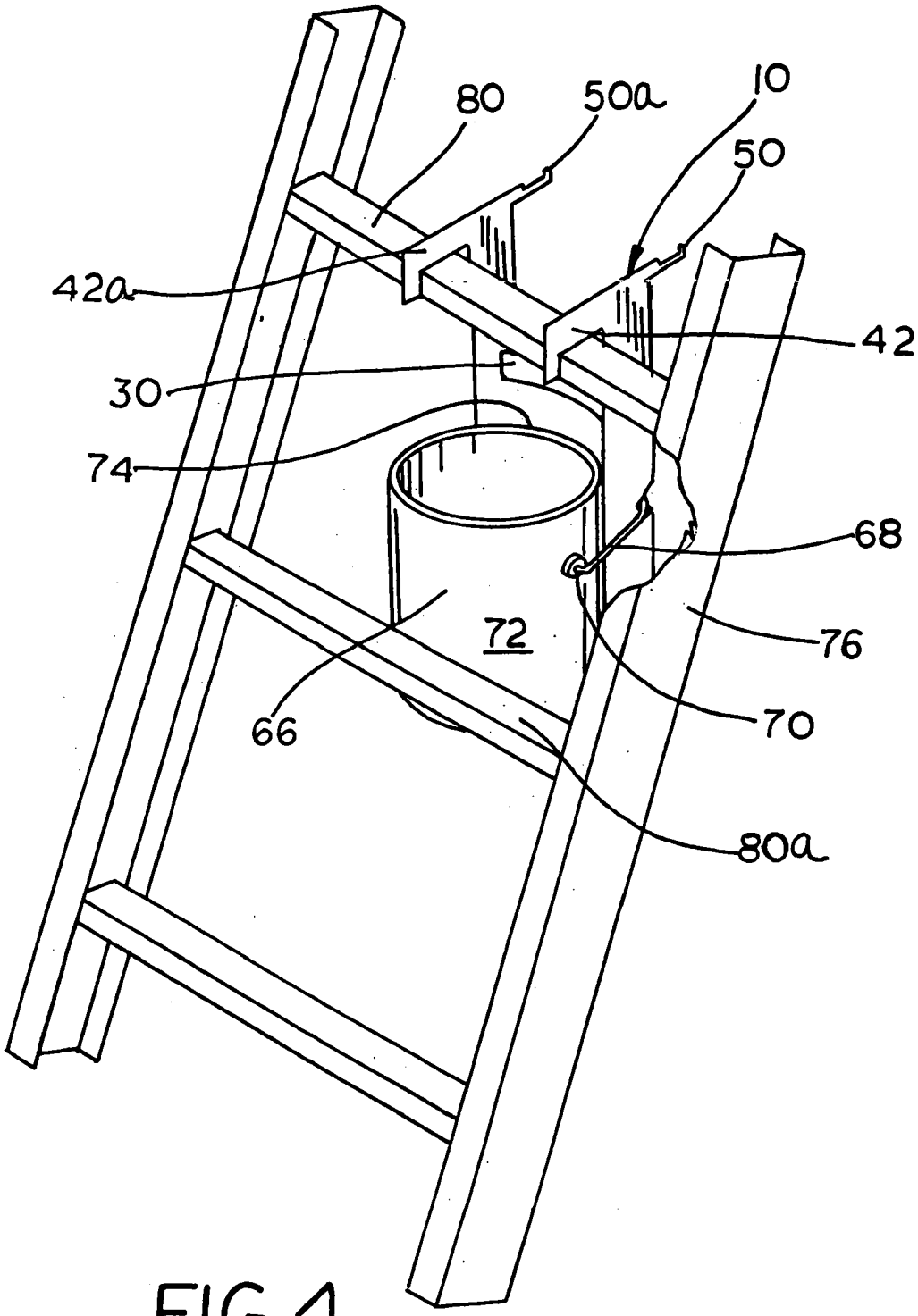
FIG. 4 is a perspective view of the can support device of FIGS. 1–3 shown attached to a ladder.
Figure 5:
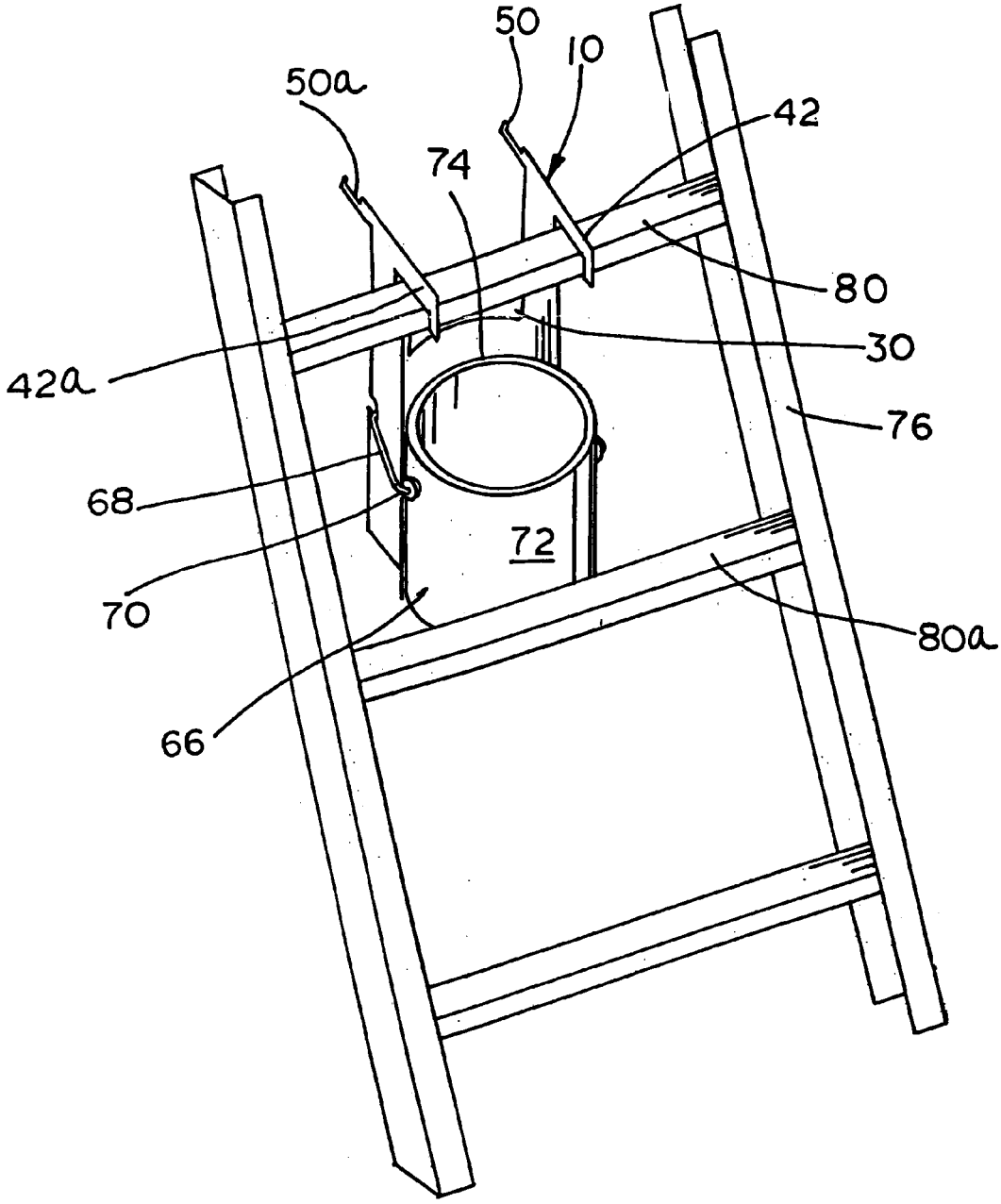
FIG. 5 is another perspective view of the can support device attached to a ladder.
Figure 6:
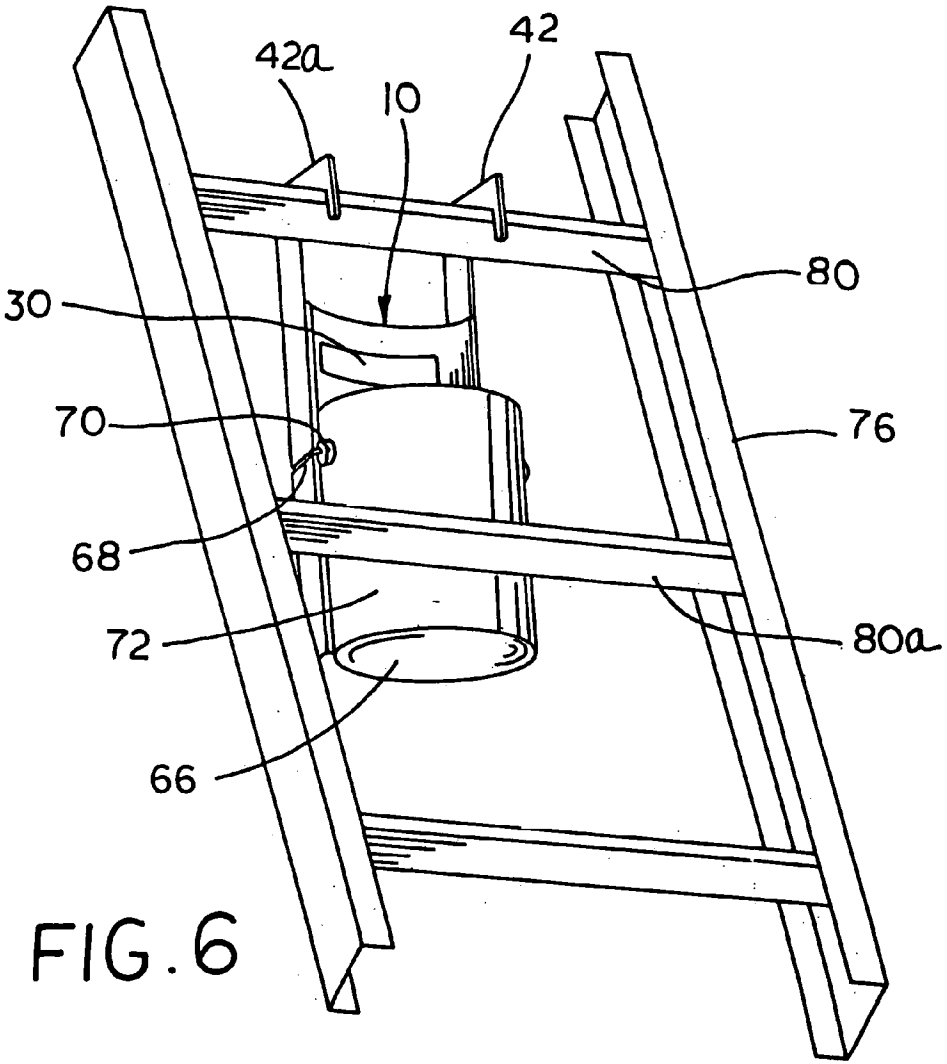
FIG. 6 is yet another perspective view of the can support device attached to a ladder.

In the disclosed embodiment, the can support device 10 is a useful device to facilitate painting tasks performed at heights that require using a ladder, such as the ladder 76 illustrated in FIGS. 4–6. The can support device 10 thus forms a support for the paint can 66, as well as for brushes and other tools (not shown) in such a manner that they hang from the can support device 10 in close proximity to the ladder 76. The frame has a channel-shaped cross-section with a concave web.

In the disclosed embodiment, the can support device 10 includes a longitudinal axis 78 (FIGS. 1–3) that is generally parallel to an axis 80 (FIGS. 2 and 3) of the can 66. It will be noted that the can support device 10 is longer than the height of a standard paint can 66. Also, in the disclosed embodiment the side edges 36, 36*a* of the side members 14, 16 are oriented to face away from the can 66.

Figure 13:
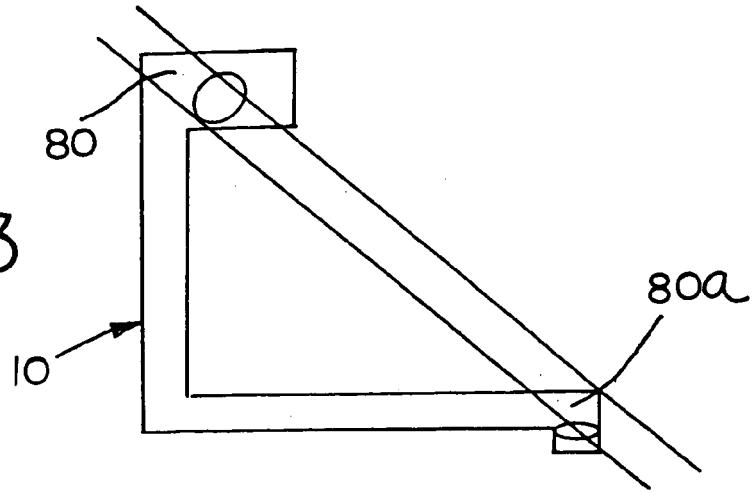
FIG. 13 is a side elevational view of a can support incorporating an optional third leg or brace sized to engage a lower rung of a ladder.

As shown in FIGS. 3–6, the hooks 48, 48*a* which protrude from the upper portion 40, 40*a* of the side members 14, 16 engage a selected rung 80 of the ladder 76, and thus secure the can support device 10 to the ladder 76. A third hook, foot, or other protrusion (FIG. 13) may protrude from the bottom of the central section 12, or from the bottom portion of the side member 14 and/or 16, with the purpose of steadying the can support device 10 to the next lower rung 80*a* of the ladder 76.

It will be noted that the receiving areas 52, 52*a* of the hooks 50, 50*a* provide a convenient place for hanging paint brushes or other useful tools from the can support device 10.

In operation, the can support device 10 is used by sliding the can support device 10 between the body of the paint can 66 and the wire handle 68. The handle 68 is positioned such that it engages both notches 60, 60*a* in the side members 14, 16. Lowering the paint can 66 or lifting on the can support device 10 locks the can 66 to the can support device 10. The can support device 10 may be carried using the oblong handle 30 formed at least in part by the cutout 26 and the cross member 28.

The can support device 10 may be fabricated from a variety of materials including plastic, composites, or formed metal to name several examples. The can support device 10 may be formed using any one of a number of suitable forming techniques, such as thermo-forming, blow-molding, vacuum forming, or injection molding (in the event the can support device 10 is manufactured of a plastic or other suitable material). The can support device 10 may alternatively be stamped and formed from a suitable gauge of sheet metal. Presently, injection molding may be preferred. Any of the above methods may be used to form the can support device 10 as an integral or one-piece unit. Alternatively, the can support device 10 may be assembled from a number of component parts.

In accordance with the disclosed example, a number of features and variations may be contemplated. The following examples are illustrative only and in no way are intended to limit the scope of the invention to the exemplary details discussed. These illustrative examples include:

1) The number and type of hooks and or protrusions used may vary from the configurations described above. The continuous top hook or a continuous bottom foot may be used, or a different number of top hooks and/or bottom feet may be employed. Further, one, two, or all hooks and/or protrusions or feet may be hooked or suitably secured to the ladder rung(s) to prevent spontaneous or unintentional disengagement from the ladder rung.

2) The number, configuration, and location of hooks for supporting paint-brushes may vary.

3) The can support device 10 may be configured such that it provides a foot or feet for hanging free from the ladder rung without being supported or steadied by a lower foot or protrusion. There may also be the option of providing support through the use of a swinging or movable foot. This foot could be mounted via a post or rung from the bottom of the can support device. The foot could be swung out of the way to allow the fixture to freely hang from the upper rung, or, alternatively, such a foot could be hooked onto the rung to steady the can support device.

4) The can support device 10 is not limited to painting tasks. The can support device 10 may be used in conjunction with an empty can to carry and support any tools (e.g. scrapers, additional brushes, rollers, hammers, or other useful tools) that may be required when working at elevation from an extension ladder.

In forming the can support device 10 is formed, preferably by injection molding. Alternatively, a blank 82 following the outline shown in FIG. 6 may be formed from a continuous sheet of suitable material, such as a sheet of polyethylene. The blank 82 may be stamped or otherwise suitably cut from the sheet of material. It will be understood that, in such an example, the blank 82 would start out as generally planar.

Using a suitable forming or stamping process, the concave and convex curved surfaces 62, 64 are formed. The side members 14, 16 are bent along their respective fold lines 22, 24, to the desired orientation. It will be understood that the term "fold line" is used for ease of reference. The formation of the fold lines 22, 24 can encompass any suitable process wherein the fold lines are formed or molded with the side members 14, 16 and does not necessary mean the folded lines were created by a "folding" process. In the disclosed embodiment, the side member 14 and the side member 16 are generally parallel to each other after folding along their respective fold lines 22, 24. Alternatively, the side members 14 and 16 may be angled slightly relative to each other, thus permitting a number of identical can support devices 10 to be placed on a surface and stacked on top of each other.

Figure 7:
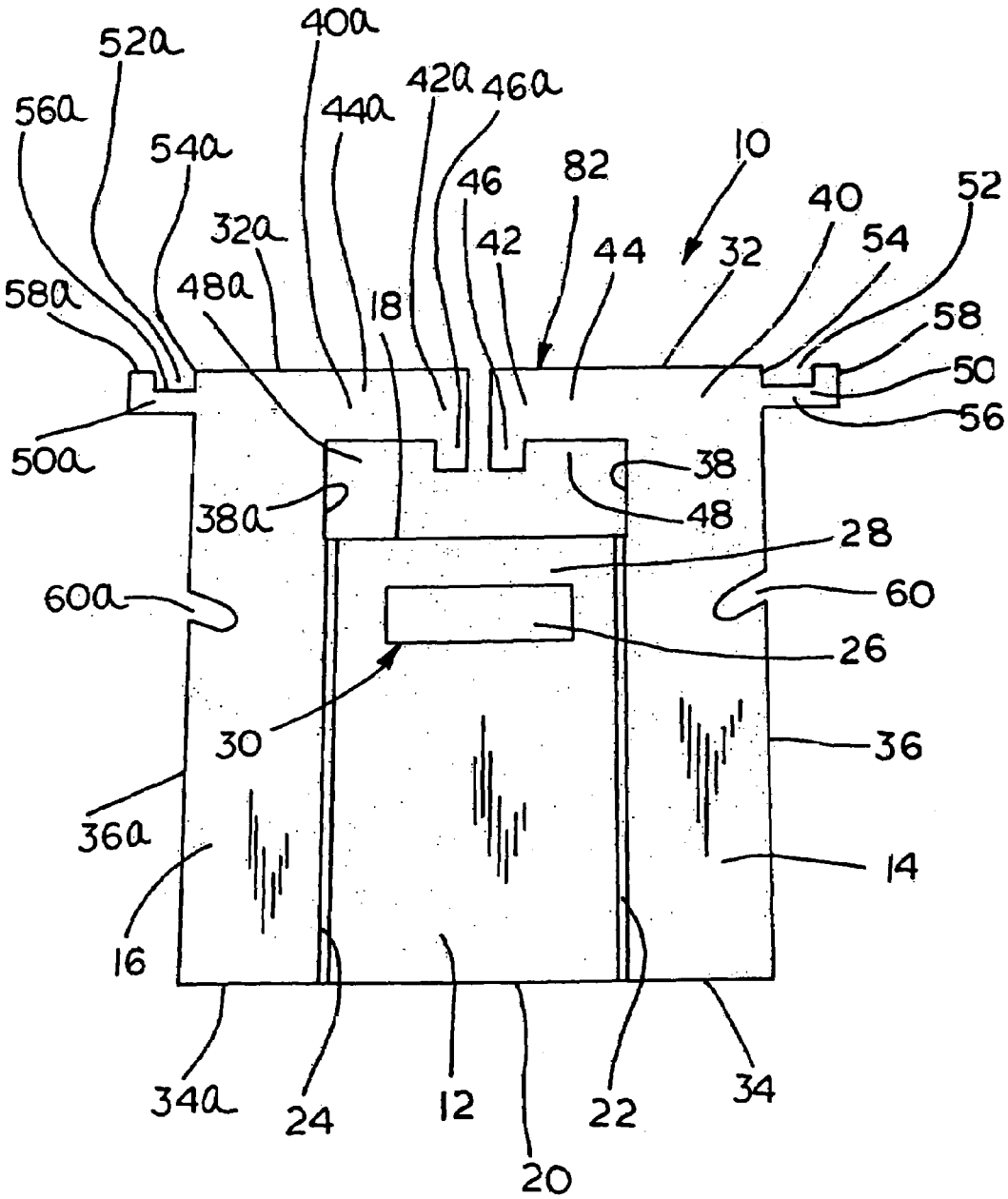
FIG. 7 is a top plan view of a formed blank of material prior to formation, in accordance with one possible method of assembly, into the can support device illustrated in FIGS. 1–6.

Prior to folding the outlines of the hooks 42, 42*a*, 50, 50*a*, the notches 60, 60*a*, and the handle 30, are all formed in the blank 82. Consequently, after folding along the fold lines 22, 24, no further fabrication may be required. The can support device 10 according to the disclosed embodiment is thus relatively quick and cost effective to fabricate, and may be formed in as few as two steps 1) shaping the blank 82 by stamping so that the blank 82 has the outline shown in FIG. 7; and 2) forming the blank 82 into the can support device 10 to take the shape of FIGS. 1–6.

Figure 8:
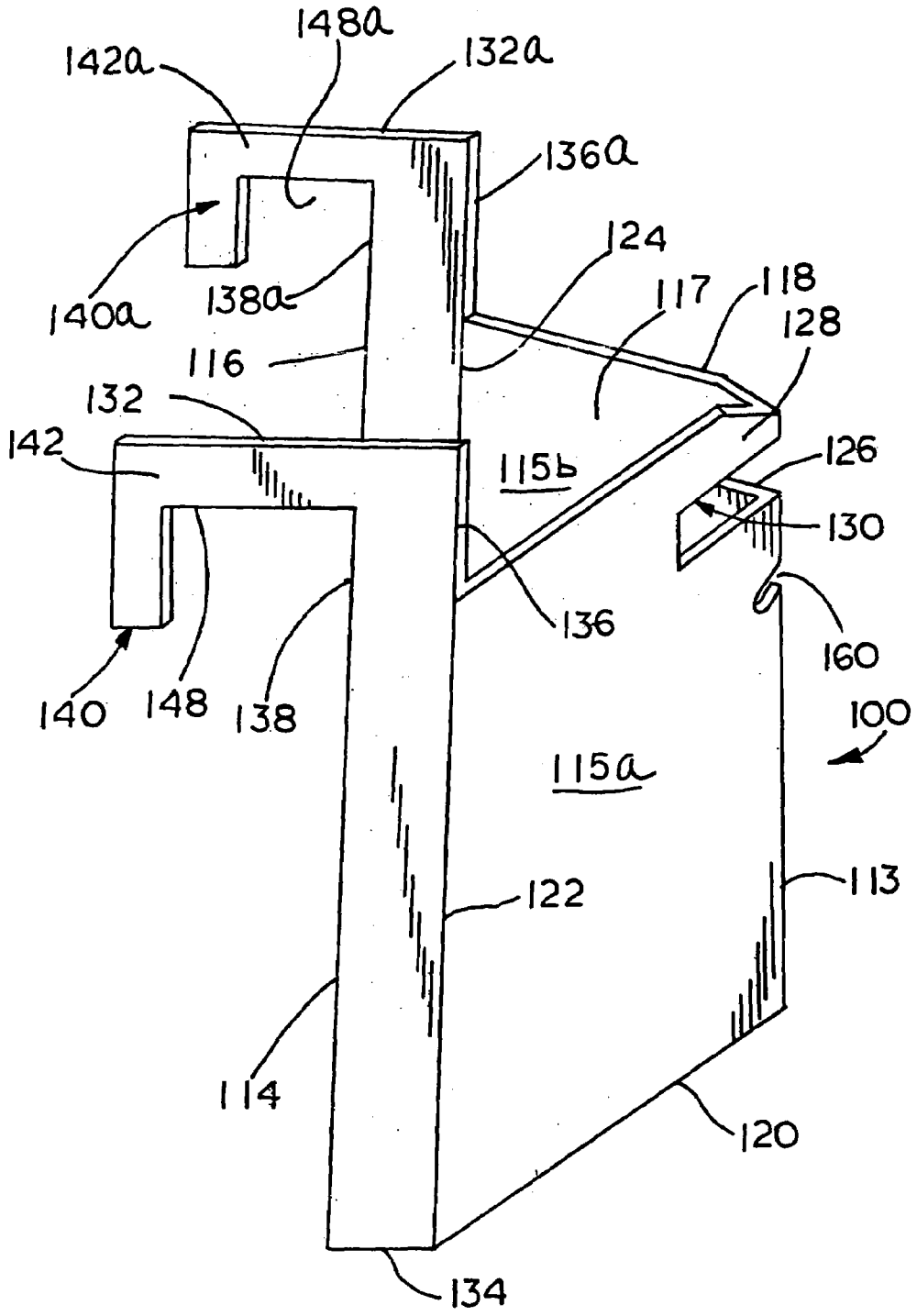
FIG. 8 is a perspective view from above of a can support device assembled in accordance with the teachings of a second disclosed embodiment of the present invention.

Referring now to FIG. 8 of the drawings, a can support device assembled in accordance with the teachings of a second disclosed embodiment of the invention is generally referred to by the reference numeral 100. The can support device 100 includes a central section 112 and a pair of side members 114, 116. The central section 112 includes a top edge 118, a bottom edge 120, and is generally bounded by a pair of fold lines 122, 124. The side members 114 and 116 are generally parallel to each other. It will be noted that the side member 114 generally meets the central section 112 at the fold line 122, while the side members 116 generally meets the central section 112 along the fold line 124. The central section 112 also includes a cutout 126 which extends generally parallel to the top edge 118, and which is separated from the top edge 118 by a cross member 128, such that the cutout 126 and the cross member 128 cooperate to form a handle 130.

The side member 114 includes an upper edge 132, a lower edge 134 and a side edge 136, with the side edge 136 preferably extending generally parallel to the fold line 122. The side member 114 also includes a side edge 138 which extends generally parallel to the side edge 136, with the edge 138 generally extending upwardly from the fold line 122. Thus, the side edge 138 is generally parallel to and across from an upper portion of the side edge 136. The side member 114 includes an upper portion 140 defining a hook 142. The hook 142 includes a receiving area 148 that faces in a generally downward direction when the can support device 110 is oriented as shown, so as to engage a ladder rung (not shown).

Similarly, the side member 116 includes an upper edge 132*a*, a lower edge 134*a* (obscured in FIG. 8), and a side edge 136*a*, with the side edge 136*a* preferably extending generally parallel to the fold line 124. The side member 116 also includes a side edge 138*a* which extends generally parallel to the side edge 136*a*, with the side edge 138*a* generally extending upwardly from the fold line 124. Thus, the side edge 138*a* is generally parallel to and across from an upper portion of the side edge 136*a*. The side member 116 includes an upper portion 140*a*. The upper portion 140*a* includes a hook 142*a* having a downwardly oriented receiving area 148*a*.

The central section 112 of the can support device 110 includes a fold line 113, which divides the central section 112 into a pair of panels 115*a*, 115*b*. The fold line 113 includes an angled notch 160 which extends partially onto both of the panels 115*a* and 115*b*. The panels 115*a*, 115*b* cooperate to form a receiving area 117 which faces generally to the left when viewing FIG. 8 and which is sized to receive a can therein in a manner similar to that discussed above with respect to the first disclosed embodiment. It will be appreciated that, depending on the shape of the central section 112, the receiving area 117 may contact the outer surface 72 of the paint can 66 along a generally curved interface, or, at a number of discrete points spaced about a portion of the circumference of the paint can 66.

Figure 9:
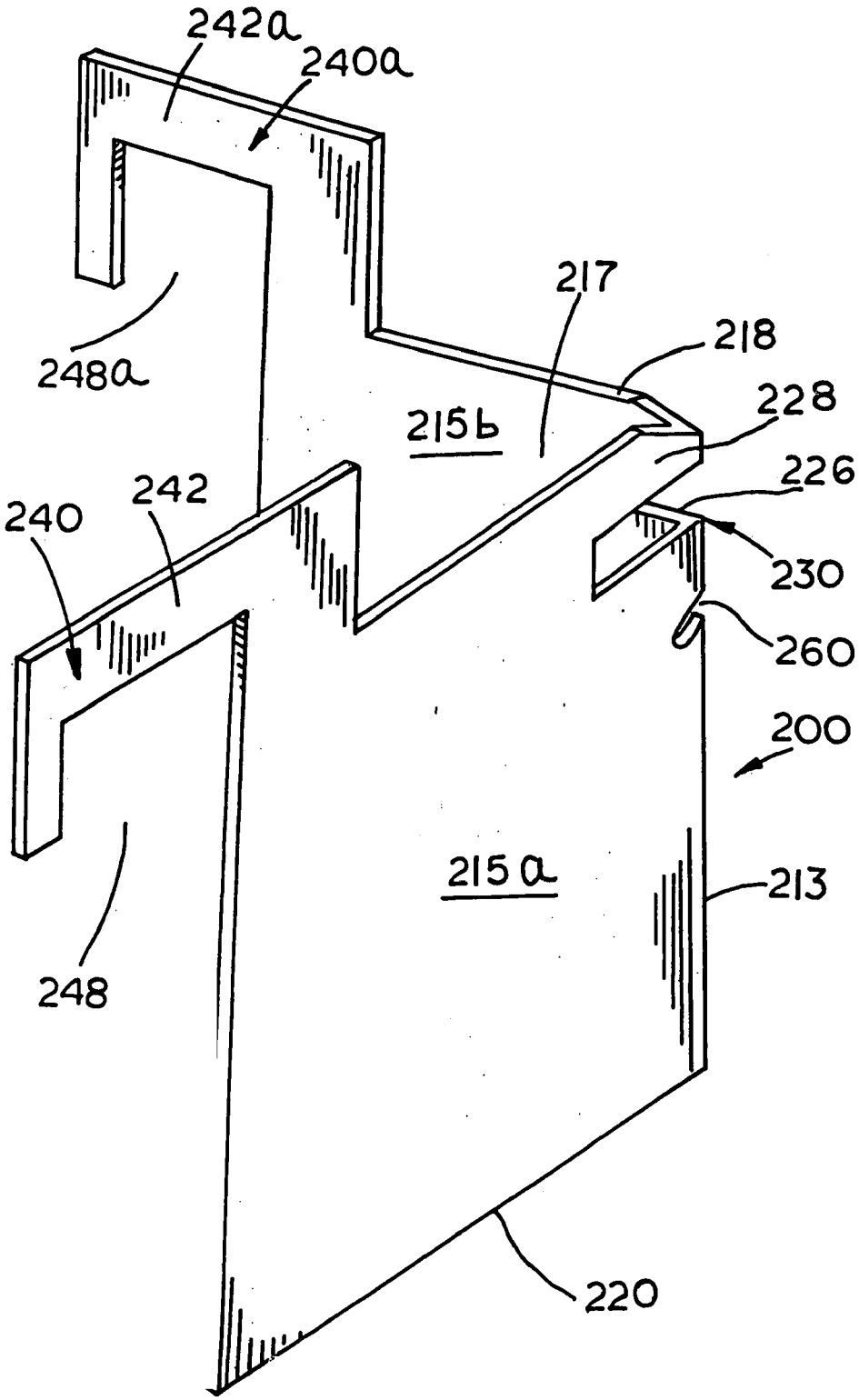
FIG. 9 is a perspective view from above of a can support device assembled in accordance with the teachings of a third disclosed embodiment of the present invention.

Referring now to FIG. 9 of the drawings, a can support device assembled in accordance with the teachings of a second disclosed embodiment of the invention is generally referred to by the reference numeral 200. The can support device 200 is substantially similar in all respects to the can support device 100, with the exception that the fold lines 122, 124 of the second embodiment are eliminated, such that the side members 214, 216 lie in substantially the same plane with the panels 215*a*, 215*b*. The can support device 200 is similar in all other respects to the embodiment of FIG. 8, and thus like elements are labeled with the same reference characters, although the reference characters have been increased by 100.

Figure 12:
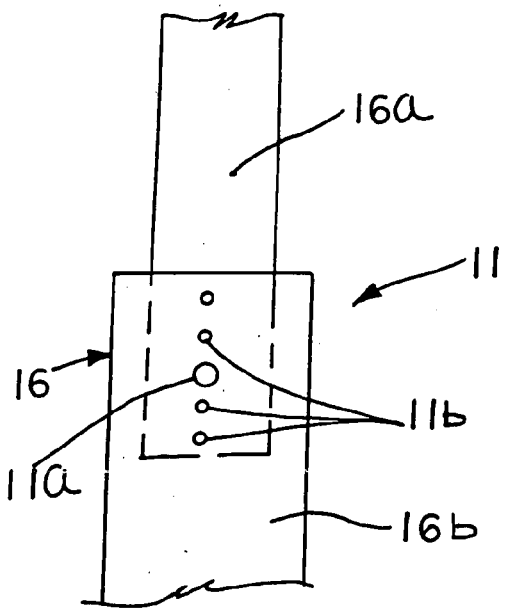
FIG. 12 is an enlarged fragmentary elevational view illustrating an optional length adjustment mechanism for use with the side members of any one of the exemplary can support devices.

FIG. 12 illustrates an optional length adjustment mechanism 11 for use with either of the side members 14 or 16. In the example shown, the side member 16 is divided into an upper section 16*a* and a lower section 16*b*, and an adjustable pin mechanism 11*a* which engages one of a plurality of holes 11*b* permits the overall length of the side member 16 to be adjusted.

Figure 14:
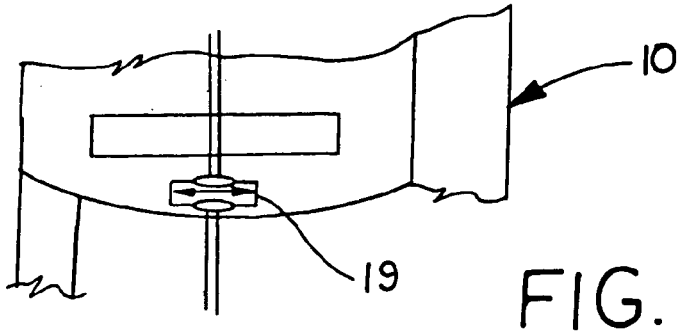
FIG. 14 is an enlarged fragmentary view in perspective of an optional hose clamp for clamping the hose of a spray painting implement.

FIG. 14 illustrates the can support device 10 equipped with an optional hose clamp 19. The hose clamp 19 may be attached to, for example, the central section 12, and may be sized to engage a hose from a spray painting implement (not shown).

Referring now to FIGS. 15–20, a can support device assembled in accordance with the teachings of another disclosed example of the present invention is shown and is generally referred to by the reference numeral 110. The can support device 110 may be similar in many respects to the can support device 10 discussed above and, to the extent possible, like or similar components will have the same reference number, although increased by 100.

The can support device 110 includes a central section 112 and a pair of side members 114, 116. The central section 112 includes a top edge 118, a bottom edge 120, and is generally bounded by a pair of fold lines 122 and 124. It will be noted that the side member 114 generally meets the central section 112 at the fold line 122, while the side member 116 generally meets the central section 112 along the fold line 124. The central section 112 also may include one or more cutouts, with three such cutouts 126*a*, 126*b* and 126*c* shown in the disclosed example. At least the top cutout 126*a* may preferably extend generally parallel to the top edge 118, and may be separated from the top edge 118 by a cross member 128, such that the cutout 126*a* and the cross member 128 cooperate to form a handle 130.

The side member 114 includes an upper edge 132, a lower edge 134 and a side edge 136, with at least a lower portion the side edge 136 preferably angled slightly such that the side member 114 narrows slightly toward the lower edge 134. The side member 114 also includes a side edge 138 which extends generally parallel to the side edge 136, with the edge 138 extending upwardly from the termination point of the fold line 122. The side member 114 includes an upper portion 140, with the upper portion 140 preferably including a forward facing hook 142 and a rearward facing hook 150. The hook 142 is defined by a pair of legs 144, 146, which cooperate to define a receiving area 148. The second hook 150 includes a receiving area 152 which is defined by a pair of legs 156 and 158. Preferably, the side edge 136 of the side member 114 includes an angled notch 160. Preferably, the notch 160 is angled downwardly, such that the opening of the notch (formed in the edge 136) is disposed higher than the end or termination point of the notch. The shape of the notch may take a variety of forms.

Similarly, the side member 116 includes an upper edge 132*a*, a lower edge 134*a* (visible at the cutaway in FIG. 15) and a side edge 136*a*, with at least a lower portion of the side edge 136*a* preferably angled slightly such that the side member 116 narrows slightly toward the lower edge 134*a*. The side member 116 also includes a side edge 138*a* which extends generally parallel to the side edge 136*a*, with the edge 138*a* extending upwardly from the termination point of the fold line 122. The side member 114 includes an upper portion 140*a*, with the upper portion 140*a* preferably including a forward facing hook 142*a* and a rearward facing hook 150*a*. The hook 142*a* is defined by a pair of legs 144*a*, 146*a*, which cooperate to define a receiving area 148*a*. The second hook 150*a* includes a receiving area 152*a* which is defined by a pair of legs 156*a* and 158*a*. Preferably, the side edge 136*a* of the side member 116 includes an angled notch 160*a* (visible at the cutaway in FIG. 15).

Figure 15:
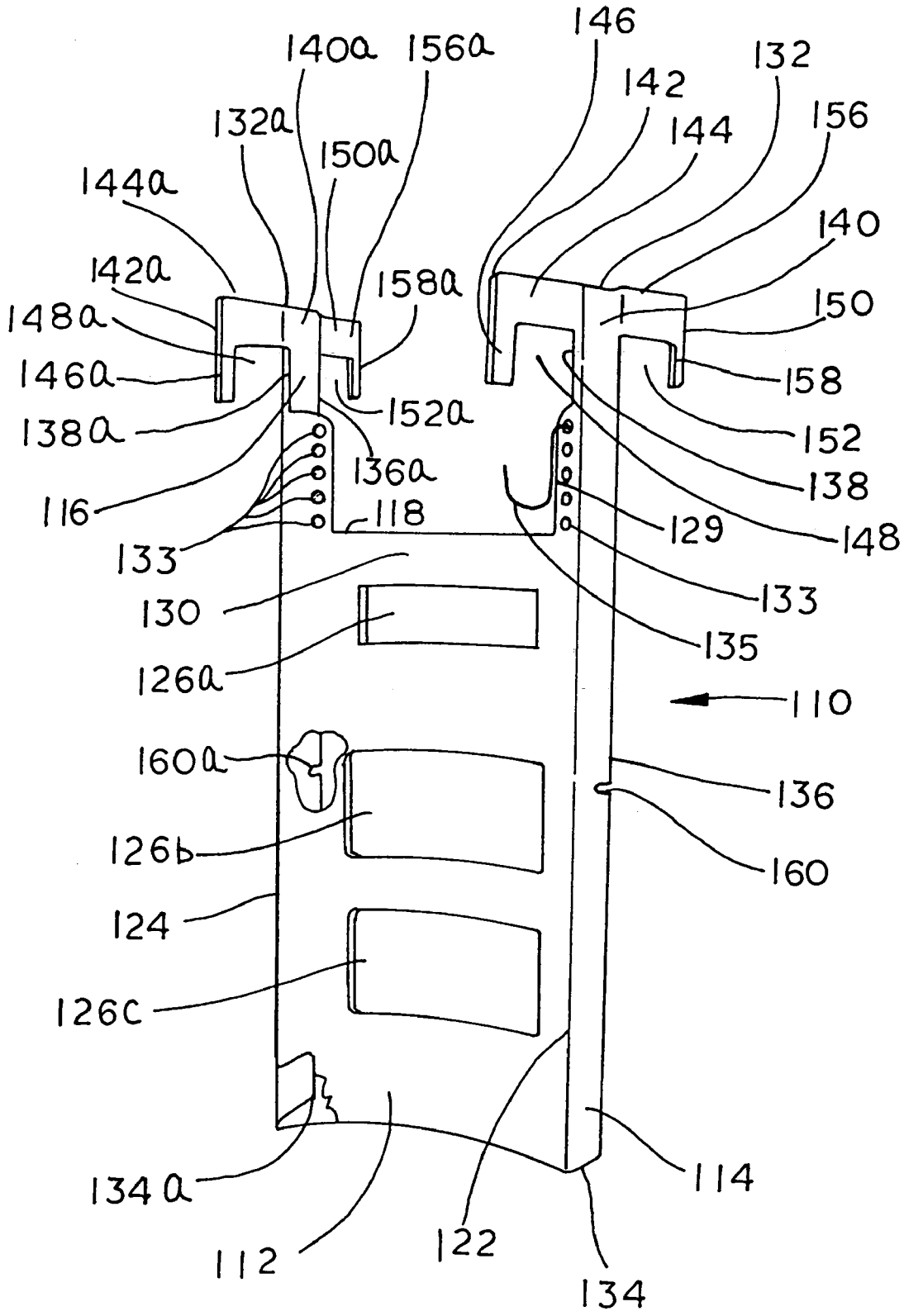
FIG. 15 is a perspective view of a can support device assembled in accordance with the teachings of another disclosed example of the present invention and having optional accessory supports.
Figure 16:
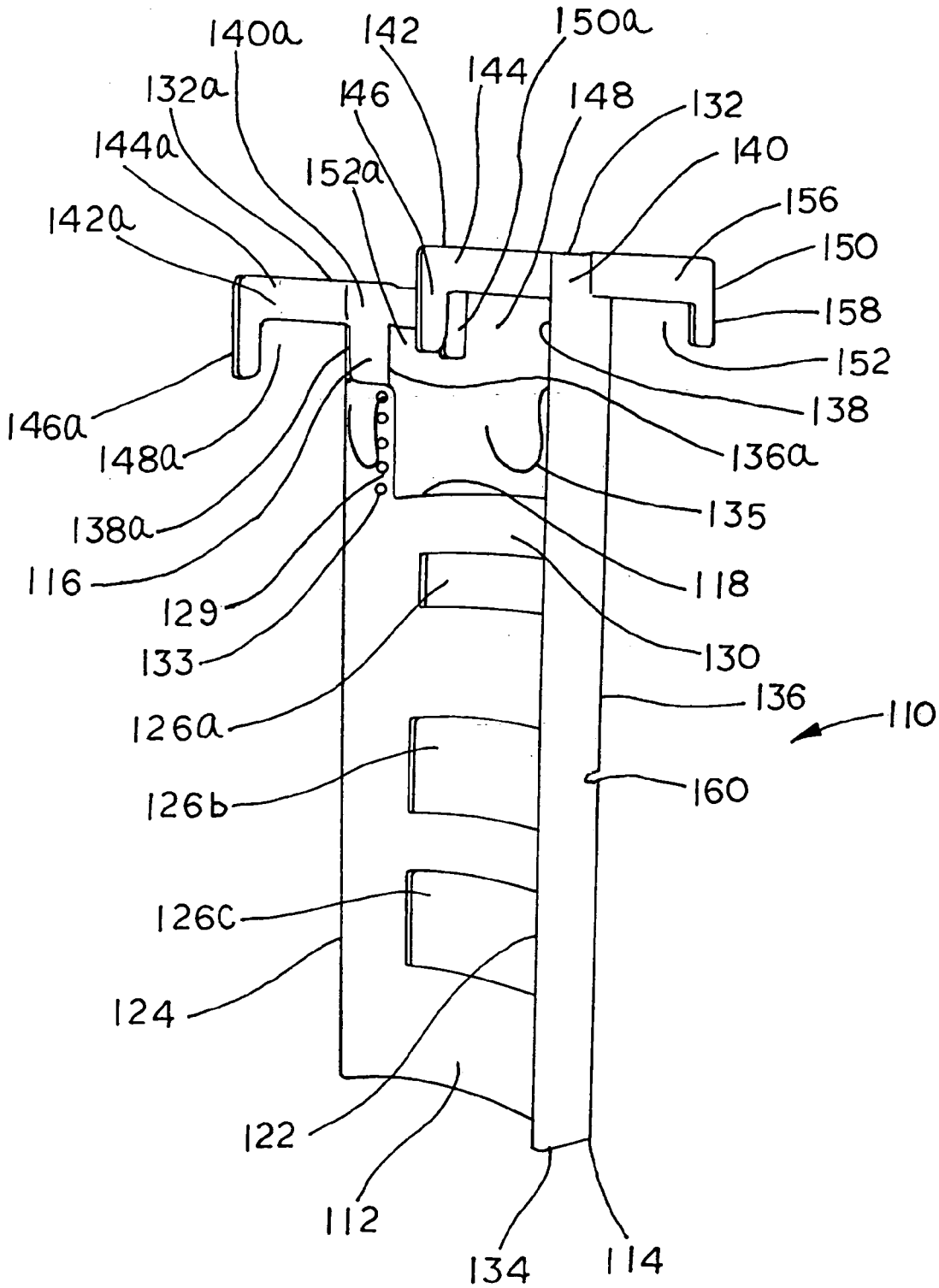
FIG. 16 is another perspective view of the can support device of FIG. 15.

The can support device 110 may further include one or more accessory supports 129. As shown in FIGS. 15, the accessory supports 129 are disposed generally upward from the top edge 118 of the center section 112. The accessory supports 129 may be formed by upward extensions of the center section 112, and may generally follow the curvature or other shape of the center section 112. In accordance with the disclosed example, the accessory supports 129 may also serve to reinforce and/or stiffen the upper parts of the side members 114, 116.

Figure 17:
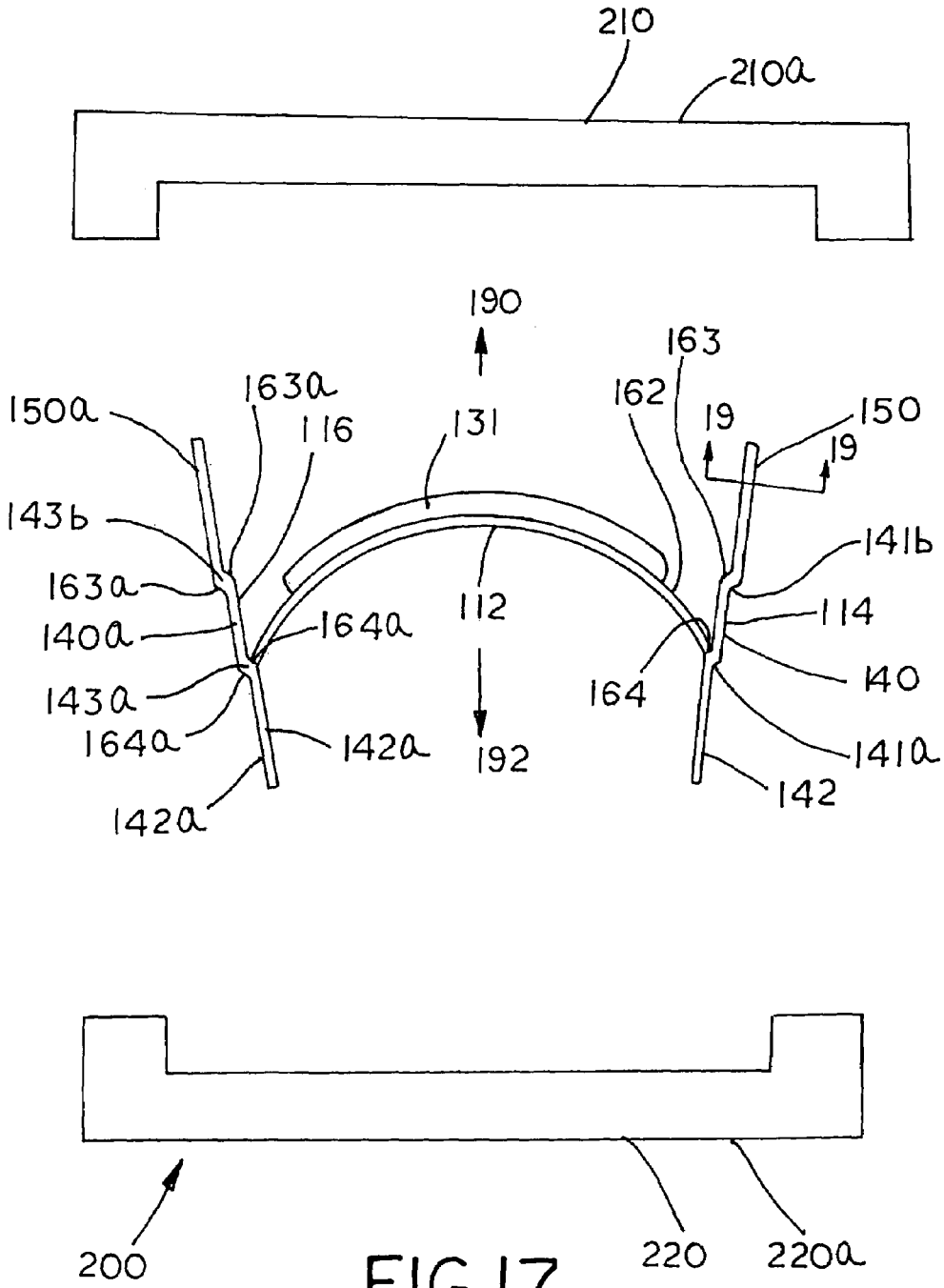
FIG. 17 is a top plan view of the can support device of FIGS. 15 and 16.
Figure 18:
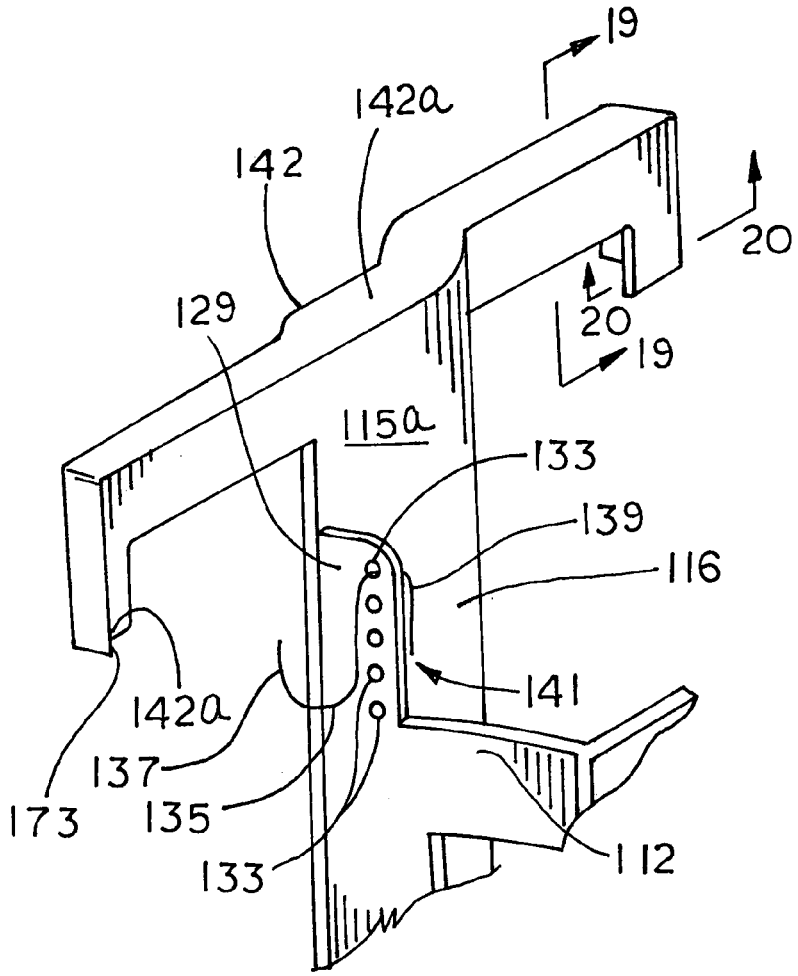
FIG. 18 is an enlarged fragmentary view in perspective of an upper portion of the can support device of FIGS. 15–17.
Figure 20:
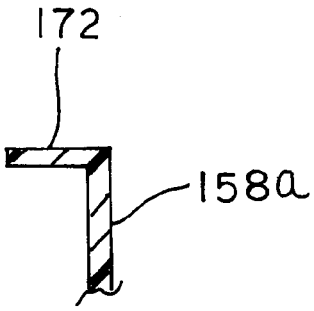
FIG. 20 is an enlarged cross-sectional view taken along line 20—20 of FIG. 18.

Referring to FIG. 18, each accessory support 129 includes a plurality of apertures 133 sized to receive a correspondingly sized hook 135 (shown in FIG. 17). Each hook 135 includes a front hook-shaped portion 137 and a rear mounting loop 139. The mounting loop 139 includes a gap 141 to allow mounting of the mounting loop 139 in any one of the apertures 133. The gap 141 may be slightly larger than the thickness of each accessory support 129. Accordingly, removing each hook 135 from one of the apertures 133 will preferably require some degree of effort, thereby minimizing the chances of inadvertent disengagement. In other words, the hook 135 will not easily fall out of the corresponding aperture 133. The orientation of the mounting loop 133 may be opposite to the orientation of the hook-shaped portion 137. Other shapes for the hook 135 may prove suitable. Accordingly, as shown in FIG. 18, when the mounting loop 133 of each hook 135 is mounted in one of the apertures 133, the hook-shaped portion 137 will be conveniently oriented upward. A user of the can support device 110 can hang painting or cleaning accessories such as, for example, brushes, rollers, scraping tools, and the like from each hook 135. Any number of apertures 133 in any pattern can be provided on each accessory support 129 in order to provide support for a desired number of hooks 135.

Referring now to FIG. 17, the upper portion 140 of the side member 114 may include one or more offsets 141*a* and 141*b*, such that the hooks 142 and 150 are disposed in different planes when viewed from above as shown in FIG. 17. Similarly, the upper portion 142 of the side member 116 may include one or more offsets 143*a* and 143*b*, such that the hooks 142*a* and 150*a* are disposed in different planes. Accordingly, the offset between the first hook 142 and the second hook 150 may be generally equal to the thickness of the side member 114, and the offset between the first hook 142*a* and the second hook 150*a* may be generally equal to the thickness of the side member 116.

Referring still to FIG. 17, side members 114 and 116 may be slightly splayed or angled outwardly slightly in direction generally away from the convex curved surface 162, such that the hooks 150 and 150*a* are spaced apart a distance slightly greater than the distance between the hooks 142 and 142*a*. In accordance with the disclosed example, this slightly angled configuration may help to secure the wire handle of the container in place within the notches 160. Further, and owing at least in part to the slightly resilient nature of the can support device 110 when assembled in accordance with the disclosed example, the notches 160 and 160*a* may resiliently press on or bear against a portion of the wire handle 168 in order to assist in securely holding the wire handle 168 in the notches 160 and 160*a*. Accordingly, in the disclosed example, to release the handle 168 from the notches 160, the side members 114 and 116 may be pivoted relative to each other (for example, by manipulating the hooks 150 and 150*a* toward or away from each other) in order to facilitate the release of the wire handle from the notches 160 and 160*a*.

As shown in FIG. 17, the handle 130 may include a stiffening rib 131 formed around or generally adjacent to the cutout 126*a*. The stiffening rib 131 may extend outwardly toward the convex surface as shown in FIG. 17, or it may extend in the opposite direction. Additionally, the stiffening rib 131 may provide a surface on which the fingers of a user can rest to provide a more comfortable hold on the handle 130. It will be appreciated that other stiffening ribs may be provided in other locations as desired. A stiffening rib can be incorporated into any of the components of the can support device 110 by manufacturing the component with a flanged cross section.

As described above, the angled configuration of the side members 114 and 116 provides the function of resiliently pressing the notches 160 on the wire handle 168 to hold the wire handles 168 in the notches 160. To release the handles 168, the side members 114 and 116 can be pivoted outward relative to each other. The pivoting of the side members 114 and 116 may be performed by pivoting the hooks 142, 150, 142*a* and/or 150*a*.

The can support device 10 can be manufactured with plastic, polymer, or resin materials, such as polypropylene, ABS (acrylonitrile butadiene styrene), or the like. One of ordinary skill in the art will readily appreciate that when the can support device 110 is constructed by any suitable process such as, for example, blow molding, injection molding, etc. Thus, a mold having two mold parts or halves may be provided.

When the can support device 110 is in a mold 200 having a first half 210 and a second half of 220 (the mold 200, including the halves 210 and 220 are shown schematically in FIG. 17 and would be shaped appropriately to correspond to the structure of the can support device), the mold 200 is configured such that the half 210 of the mold 200, which is the mold half that is removed after injection molding, faces the convex curved surface 164. Accordingly the concave curved surface 162 is oriented downward in the other half 220 of the mold 200. The open and close direction of the mold is shown by the arrows 190 and 192, respectively.

As described below, the offset in the hooks 142, 150 and 142*a*, 150*a*, in combination with the angled configuration of the side members 114 and 116 serve to conveniently facilitate release of the can support device 10 from the mold after the injection molding process. For example, as shown in FIG. 17, the outside faces of the hooks 142 and 150 and the transition surfaces 141*a* and 141*b* (the outside faces being disposed to the right when viewing the FIG.) are formed by the mold part 220 and generally face the mold part 220 at some angle less than perpendicular to a plane 220*a* of the mold part 220.

Further, and referring still to FIG. 17, the offset in the hooks 142 and 150 relative to the side member 114 creates transition surfaces 161 and 163, respectively. Similarly, the offset in the hooks 142*a* and 150*a* relative to the side member 116 creates transition surfaces 161*a* and 163*a*, respectively. Because the first hook 142 extends from an inner side 143 of the panel 115 and the second hook 150 extends from an outer side 145 of the panel 115, and the side member 114 is angled outward relative to the convex curved surface 164, the transition surfaces 161 and 163 are positioned on the inner side 143 of the panel 115 relative to each other in an outwardly stepped configuration. Similarly, because the first hook 142*a* extends from an inner side 143*a* of the panel 115*a* and the second hook 150*a* extends from an outer side 145*a* of the panel 115*a*, and the side member 116 is angled outward relative to the convex curved surface 164, the transition surfaces 161*a* and 163*a* are positioned on the inner side 143*a* of the panel 115*a* relative to each other in an outwardly stepped configuration. Thus, the surfaces face the mold part 210 at some angle less than perpendicular relative to a plane 210*a* of the mold part 210. Thus, if one were to look at the back side of the device (e.g., look toward the convex surface) from the vantage point of the mold half 210*a*, all of the surfaces formed by the mold half 210*a* would be visible to the viewer (with the possible exception of some surfaces that may be parallel to the line of sight, such as the stiffening rib 131). Similarly, if one were to look at the front side of the device (e.g., look toward the concave surface) from the vantage point of the mold half 220*a*, again all of the surfaces formed by that mold half would be visible to the viewer (with the same noted possible exceptions). It will be appreciated that the foregoing discussion is exemplary only, and that other methods and mold shapes may similarly prove suitable.

The outwardly stepped configuration of the transitions surfaces 161, 163, 161*a* and 163*a* is in the open direction 190 of the mold. Additionally, the angle of the side members 114 and 16 relative to each other is outwardly relative to the open direction 190 of the mold. Because of the above-described outwardly stepped configuration of the transition surfaces 161, 163,161*a*, and 163*a*, and the outward angled orientation of the side members 114 and 116, the can support device 110 can disengage from the mold. In other words, the transition surfaces 161, 163, 161*a* and 163*a*, do not hinder the removal of the mold halves because none of the transition surfaces are perpendicular to the open direction 190 of the mold.

Figure 19:
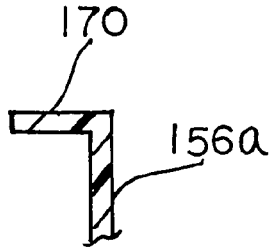
FIG. 19 is an enlarged cross-sectional view taken along line 19—19 of FIG. 18.

Referring now to FIG. 19, the upper portion 140 may include a laterally extending flange 170. Similarly, and referring now to FIG. 20, the downwardly extending portion of the hook may include a laterally extending flange 172. Still further flanges may be formed at other locations on the upper portion 170 and/or on either one of the hooks 142 and/or 150. It will be appreciated that the hooks 142*a* and 150*a* may similarly include flanges as desired.

Figure 21:
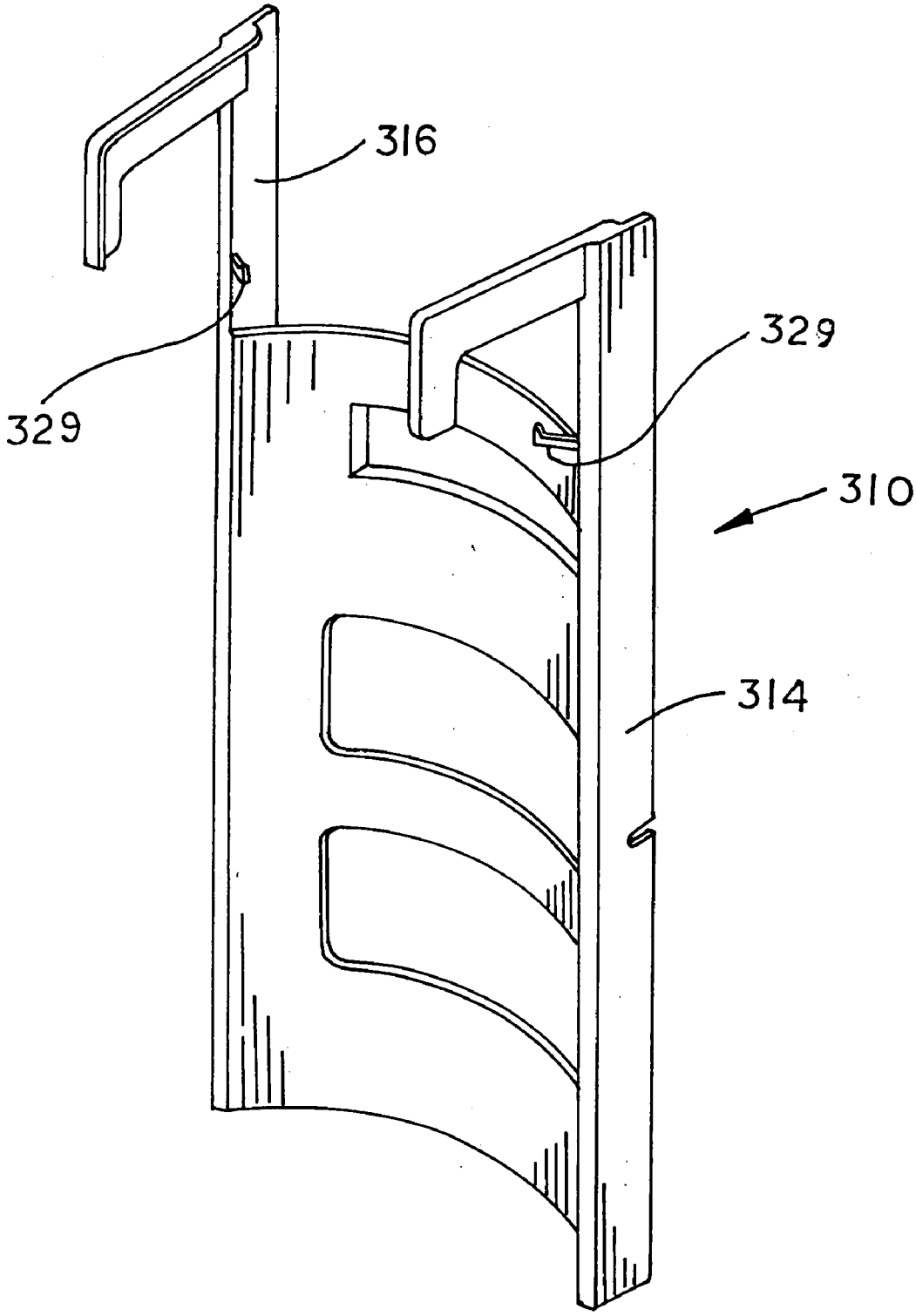
FIG. 21 is a perspective view of another exemplary can support device.

Referring now to FIG. 21, another exemplary can support device is shown and is referred to by the reference numeral 310. The can support device 310 is similar in may respects to the examples discussed above, and includes a pair of accessory supports 329 formed on each of the side members 314 and 316.

It will be appreciated that other methods of manufacture may prove suitable for making any of these samples disclosed herein. Further, it will be appreciated that many of the details of the various examples disclosed herein need not be mutually exclusive. In other words, each of the examples may include features from the other examples.

Persons of ordinary skill in the art will appreciate that, although the teachings of the present disclosure have been illustrated in connection with certain examples, there is no intent to limit the present disclosure to such examples. On the contrary, the intention of this application is to cover all modifications and examples fairly falling within the scope of the teachings of the present disclosure.

What is claimed is:

1. A device for supporting a container on a support structure, the container having a wire handle and a curved sidewall, the device comprising:

a pair of spaced apart side members, each of the side members having an upper portion adapted to engage the support structure, each of the side members further having a notch sized to receive the wire handle;

a central portion disposed between the side members, the central portion defining a receiving area sized and shaped to receive the container, the receiving area further sized and shaped to engage only the sidewall of the container along an elongate and longitudinally extending curved interface;

the notch of each of the side members and the curved interface arranged such that the container is supportable exclusively by the notches and the curved interface; and an upper portion of at least one of the side members including at least one aperture, the aperture sized and shaped to receive a support hook.

2. The device of claim 1, wherein an upper portion of each of the side members includes a plurality of apertures sized and shaped to receive a support hook.

3. The device of claim 1, wherein each of the side members defines a plane, and wherein the plane of one side member is angled relative to the plane of the other side member.

4. The device of claim 3, wherein at least one of the central portion and the pair of side members is flexible to permit the angle between the side member planes to be altered.

5. The device of claim 1, including one or more stiffening ribs integrally formed in at least one of the central portion and the upper portion of the side members.

6. The device of claim 1, wherein the central portion includes a cutout parallel to a top edge of the central portion, the cutout separated from the top edge by a cross member, the cross member and the cutout cooperating to form a handle.

7. The device of claim 6, wherein the central portion includes a widened flange adjacent the handle.

8. The device of claim 1, wherein the side members and the central portion are constructed from a plastic material.

9. The device of claim 8, wherein the plastic material is any of polypropylene and acrylonatrile butadeine styrene.

10. A device for supporting a wire-handled container on a support structure, the container having a sidewall, the device comprising:

a central panel having an interface shaped to receive a portion of the sidewall of the container;

a pair of generally non-parallel side members, each of the side members joined to an opposite side of the central panel along a line or intersection; each of the side members having a rearward edge disposed away from the line of intersection, each edge having a notch sized to receive the wire handle of the container;

a hook carried by an upper portion of each of the side members, each hook shaped to engage the support structure; and the notch of each of the side members and the interface arranged such that the container is supportable exclusively by the notches and the interface.

* * * * *